US011656057B2

(12) United States Patent
Levi

(10) Patent No.: US 11,656,057 B2
(45) Date of Patent: May 23, 2023

(54) BUTT STOCK FOR HANDGUN

(71) Applicant: Amit Levi, Moshav Gea (IL)

(72) Inventor: Amit Levi, Moshav Gea (IL)

( * ) Notice: Subject to any disclaimer, the term of this patent is extended or adjusted under 35 U.S.C. 154(b) by 131 days.

(21) Appl. No.: 17/417,426

(22) PCT Filed: Dec. 25, 2019

(86) PCT No.: PCT/IB2019/061356

§ 371 (c)(1),
(2) Date: Jun. 23, 2021

(87) PCT Pub. No.: WO2020/136594

PCT Pub. Date: Jul. 2, 2020

(65) Prior Publication Data

US 2022/0074702 A1 Mar. 10, 2022

(30) Foreign Application Priority Data

Dec. 26, 2018 (IL) ..... 263981

(51) Int. Cl.
*F41C 23/12* (2006.01)
*F41C 23/04* (2006.01)
*F41C 23/14* (2006.01)

(52) U.S. Cl.
CPC ..... *F41C 23/12* (2013.01); *F41C 23/04* (2013.01); *F41C 23/14* (2013.01)

(58) Field of Classification Search
CPC ..... F41C 23/04; F41C 23/12; F41C 23/14; F41C 23/20; F41C 27/06; F41A 3/84; F41A 11/02; F41A 3/66; F41A 11/04; F41A 19/10; F41A 3/26; F41A 35/06
USPC ..... 42/71.01, 73, 1.06, 72, 74, 71.02, 42/75.01–75.1; 89/191.01, 193, 198
See application file for complete search history.

(56) References Cited

U.S. PATENT DOCUMENTS 1,497,794 A 6/1924 Saunders
4,271,623 A 6/1981 Beretta
5,092,070 A * 3/1992 Perkins ..... F41C 23/12 42/72
5,528,846 A * 6/1996 Baggett ..... F16M 13/00 224/913

(Continued)

OTHER PUBLICATIONS

International Search Report for PCT application PCT/IB2019/061356, prepared by the Israel Patent Office, dated Apr. 5, 2020.

(Continued)

*Primary Examiner* — Michael D David
(74) *Attorney, Agent, or Firm* — The Law Office of Joseph L. Felber

(57) ABSTRACT

A butt stock that is reversibly attachable to a handgun, the butt stock has a telescopic assembly and a quadrilateral assembly and has at least two states: a compact state and a deployed state. In the deployed state the telescopic assembly is in an extended conformation and the quadrilateral assembly is in an open position while in the compact state the telescopic assembly is in a contracted conformation and the quadrilateral assembly is in a closed position. The butt stock is relatively compact when in the compact state, but when attached to a handgun in a deployed state may provide multiple points of contact that potentially increase the accuracy of the handgun.

20 Claims, 21 Drawing Sheets

(56) References Cited

U.S. PATENT DOCUMENTS

| | | | | |
|---|---|---|---|---|
| 8,341,868 | B2 * | 1/2013 | Zusman | F41C 23/22 42/74 |
| 8,429,844 | B2 * | 4/2013 | Dextraze | F41A 9/71 42/73 |
| 8,448,366 | B2 * | 5/2013 | Faifer | F41G 11/003 42/72 |
| 8,844,185 | B2 * | 9/2014 | Jarboe | F41C 23/14 42/73 |
| 9,335,112 | B1 * | 5/2016 | Sholley | F41C 33/001 |
| 9,423,207 | B2 * | 8/2016 | Hunkley | F41C 23/12 |
| 9,581,411 | B2 * | 2/2017 | Zusman | F41C 23/22 |
| 11,365,952 | B2 * | 6/2022 | Hopkins | F41C 23/14 |
| 2009/0277066 | A1 | 11/2009 | Burt et al. | |
| 2017/0254613 | A1 | 9/2017 | Kedairy | |

OTHER PUBLICATIONS

Written Opinion for PCT application PCT/IB2019/061356, prepared by the Israel Patent Office, dated Apr. 5, 2020.

* cited by examiner

BUTT STOCK FOR HANDGUN

RELATED APPLICATION

The present application gains priority from Israel patent 263981 filed 26 Dec. 2018, which is included by reference as if fully set-forth herein.

FIELD AND BACKGROUND OF THE INVENTION

The invention, in some embodiments, relates to the field of handguns, and more particularly but not exclusively, to a butt stock that is reversibly attachable to a handgun, the butt stock having two states: a deployed state and a compact state.

Handguns are relatively inaccurate and have a limited effective range in part because these are fired with only two points of contact, the two hands on the grip. This is in contrast with a long gun such as a military rifle which is typically fired with at least four points of contact: a hand on the grip, a hand on the lower hand guard, cheek on the top of the stock and shoulder against the proximal end of the stock.

There exist devices that function as accessories allowing a handgun to be fired with more than two points of contact allowing more accurate fire.

One example of such a device is the Roni® pistol carbine conversion, a frame in which a handgun is locked, forming a total of four contact points as in a long gun. The large size of such pistol carbine conversions is a disadvantage for some uses.

Alternative such devices include the GLR-17 or GLR-440 tactical stocks (FAB Ltd., Modi'in, Israel) which are reversibly attachable to a handgun in tactical situations to form a total of three or four contact points and are collapsible to a state having a relatively small size. However, even in a collapsed state such stocks are too large to conveniently carry when not in use.

It would be useful to have a butt stock (also called stock, buttstock, gunstock, or shoulder stock) that is reversibly attachable to a handgun, preferably under tactical conditions. Such a butt stock would advantageously have one or more advantages over the examples cited above, for example, having a state where the butt stock is more compact than the examples cited above.

SUMMARY OF THE INVENTION

Some embodiments of the invention relate to a butt stock that is reversibly attachable to a handgun, the butt stock having a compact state and a deployed state. The butt stock is relatively compact when in the compact state, but when attached to a handgun in a deployed state may provide multiple points of contact that potentially increase the accuracy of the handgun.

According to an aspect of the invention, there is provided a butt stock reversibly attachable to a handgun, comprising:

a. a telescopic assembly, comprising:

a telescoping axis comprising at least two telescopic components: a proximal bar constituting a proximal portion of the telescopic assembly, and a distal bar physically associated with the proximal bar to telescope relative to the proximal bar in the direction of the telescoping axis, and, an adaptor attached to the distal bar, the adaptor configured for reversibly attaching the butt stock to a handgun;

b. a quadrilateral assembly comprising:

a proximal bar, a butt, a first hinge movably connecting the butt to the proximal bar, a cheek rest, a second hinge movably connecting the cheek rest to the butt, a locking bar, a third hinge movably connecting the locking bar to the cheek rest, a fourth hinge movably connecting the locking bar to the proximal bar and a butt axis passing through the rotation axis of the first hinge and the second hinge;

the quadrilateral assembly constituting a planar quadrilateral four-bar linkage;

the butt stock having at least two states:

i. a deployed state (also called unfolded or open state) wherein the telescopic assembly is in an extended conformation and the quadrilateral assembly is in an open position, ii. a compact state (also called folded, closed or collapsed state) wherein the telescopic assembly is in a contracted conformation and the quadrilateral assembly is in a closed position, wherein when the butt stock is in the deployed state and attached to a handgun, the cheek rest is configured to serve as a contact point for the cheek and the butt is configured to serve as a contact point for the shoulder of a user of the handgun.

A butt stock according to the teachings herein comprises a quadrilateral assembly that constitutes a planar quadrilateral four-bar linkage, having four bars movably connected by four hinges, as known in the art the hinges being revolute joints that allow one-degree of freedom: mutual rotation of two connected bars.

In preferred embodiments, such as in the exemplary embodiment 10 depicted in the Figures, the quadrilateral assembly constitutes a planar parallelogram four-bar linkage, wherein: in the deployed state the telescopic assembly is in an extended conformation and the quadrilateral assembly is in an open position wherein the four inner angles of the quadrilateral are between 45° and 135°, and in the compact state the telescopic assembly is in a contracted conformation and the quadrilateral assembly is in a closed position wherein two inner angles of the quadrilateral are less than 30° (and the other two inner angles are greater than 150°). As known in the art, in a planar parallelogram four-bar linkage opposing internal angles of the quadrilateral are always equal, the length of opposing sides as defined by the hinge-hinge distance are always equal in lengths, the butt is always parallel to the locking bar, and the proximal bar is always parallel to the check rest.

In some embodiments, such as the exemplary embodiment 10 described with reference to the figures, the adaptor is attached to the distal end of the distal bar.

In some embodiments, in the open position of the quadrilateral assembly the four inner angles of the quadrilateral are between 60° and 120°, between 70° and 110°, between 80° and 100° and in some embodiments between 85° and 95°. In some preferred embodiments, such as the exemplary embodiment 10, in the open position of the butt stock the four inner angles of the quadrilateral are 90°.

In some embodiments, such as the exemplary embodiment 10, the two inner angles of the quadrilateral that are less than 30° in the closed position of the quadrilateral assembly are the angles defined by butt, second hinge, cheek rest and by locking bar, fourth hinge, proximal bar.

In some embodiments, in the closed position of the quadrilateral assembly, two inner angles of the quadrilateral are less than 20° (and the other two inner angles are greater than) 160°, are less than 15° (and the other two inner angles are greater than 165°), and in some embodiments are less than 5° (and the other two inner angles are greater than 175°). In some preferred embodiments, such as the exemplary embodiment 10, in the closed position of the quadrilateral assembly two inner angles of the quadrilateral are 0° and the other two inner angles are 180°).

In some embodiments, the bars of the telescopic assembly are coaxial, i.e., the proximal bar and the distal bar, and other bars of the telescopic assembly when present, are coaxial. In the exemplary embodiment 10, all three bars of the telescopic assembly (distal bar, middle bar, proximal bar) are coaxial.

In some embodiments, such as in the exemplary embodiment 10, any two adjacent bars of the telescopic assembly are directly associated without an intervening component and are configured during extension or retraction to slide one along the other. Some such embodiments have the advantages of being cheap, simple, reliable and/or compact. In some alternative embodiments, in the interface between one or more pairs of adjacent bars of the telescopic assembly are found intervening components, for example, bearings and the like.

In some embodiments, in the contracted conformation of the telescopic assembly a majority of the distal bar is inside the proximal bar. In some embodiments, a majority is more than 50%, more than 60%, more than 70%, more than 80% and even more than 90% of the length of the distal bar being contained inside the proximal bar. In the exemplary embodiment 10, in the contracted conformation of the telescopic assembly more than 90% of the length of the distal bar is inside the proximal bar.

In some embodiments, the telescopic assembly comprises only two telescoping components, the proximal bar and the distal bar. In some preferred such embodiments, in the contracted conformation the majority of the distal bar is inside the proximal bar.

In some embodiments, such as in the exemplary embodiment 10, the telescopic assembly comprises only three telescoping components, the proximal bar, the distal bar and a middle bar located between the proximal bar and the distal bar. In preferred such embodiments, such as in the exemplary embodiment 10, in the contracted conformation the majority of the distal bar is inside the middle bar and a majority of the middle bar is inside the proximal bar. In some such embodiments, such as in the exemplary embodiment 10, in the contracted conformation of the telescopic assembly: a majority of the distal bar is inside the middle bar and the proximal bar; and a majority of the middle bar is inside the proximal bar.

In some embodiments, the telescopic assembly comprises at least four telescoping components, the proximal bar, the distal bar and at least two middle bars telescopically located between the proximal bar and the distal bar. In preferred such embodiments, in the contracted conformation the majority of the distal bar is inside a distal-most middle bar and the majority of proximal-most middle bar is inside the proximal bar.

In some embodiments having three or more telescoping components, such as in the exemplary embodiment 10, the butt stock further comprises a distal telescope locking mechanism that prevents the distal bar from telescoping to a contracted conformation relative to a preceding middle bar unless the distal telescope locking mechanism is released. In some such embodiments, such as the exemplary embodiment 10, the distal telescope locking mechanism comprises a component that, as a result of a middle bar being telescoped to a contracted conformation relative to the proximal bar, the distal telescope locking mechanism is released, allowing the distal bar to telescope to a contracted conformation relative to a more proximal middle bar. In the exemplary embodiment 10, the distal telescope locking mechanism includes a telescope locking pin, a guide lip and telescoping locking hole: when the middle bar is telescoped to a contracted conformation relative to the proximal bar, the telescope locking pin is pressed into the telescoping locking hole by the guide lip, thereby releasing the distal telescope locking mechanism so that the distal bar can telescope to a contracted conformation relative to the middle bar.

In some embodiments, such as in the exemplary embodiment 10, the butt stock further comprises a rotation-locking mechanism that prevents the quadrilateral assembly in the open position from closing to the closed position unless the rotation-locking mechanism is released (e.g. by a user). In preferred embodiments, such as in the exemplary embodiment 10, the rotation-locking mechanism is configured so that recoil of a handgun attached to the butt stock through the adaptor enhances the rotation-locking rather than weakens such locking. In some embodiments, such as in the exemplary embodiment 10, the rotation-locking mechanism comprises a locking component that is ordinarily biased to a locked position preventing rotation of the proximal bar relative to the butt, the locking component configured to be moved by a user to an unlocked position where rotation of the proximal bar relative to the butt is not prevented. In the exemplary embodiment 10, the rotation-locking mechanism includes rotation locking pins, rotation locking holes in the butt and rotation locking holes in the proximal bar, the rotation locking pins biased by a spring to a locked position that prevents rotation of the proximal bar relative to the butt.

In some embodiments, such as in exemplary embodiment 10, the butt stock further comprises a proximal telescoping locking mechanism that prevents the telescopic assembly in the extended conformation from retracting to the retracted conformation unless the proximal telescoping locking mechanism is released.

In some embodiments, such as in exemplary embodiment 10, the butt stock comprises a proximal telescoping locking mechanism that prevents the telescopic assembly in the extended conformation from retracting to the retracted conformation unless the proximal telescoping locking mechanism is released, the proximal telescoping locking mechanism configured so that:

when the quadrilateral assembly is locked in the open configuration, the proximal telescoping locking mechanism prevents the telescopic assembly in the extended conformation from retracting to the retracted conformation; and when the quadrilateral assembly is at least partially moved from the open configuration, the proximal telescoping locking mechanism does not prevent the telescopic assembly in the extended conformation from retracting to the retracted conformation. In some such embodiments, such as in the exemplary embodiments 10, the proximal telescoping locking mechanism comprises a locking tooth physically associated with the locking bar and a proximal gap in a bar most proximal to the proximal bar (in exemplary embodiment 10, a middle bar), so that:

when the quadrilateral assembly is locked in the open configuration, the locking tooth is located inside the proximal gap, preventing axial movement of the bar most proximal relative to the proximal bar; and when the quadrilateral assembly is not locked in the open configuration, the locking tooth is not located inside the proximal gap.

In some embodiments, such as in exemplary embodiment 10, the butt stock is configured so that in the compact state, the adaptor is attachable to and detachable from a handgun.

In some embodiments, such as in exemplary embodiment 10, the adaptor is configured for reversibly attaching the butt stock to a handgun by reversibly mating with an integral part of a handgun.

Additionally or alternatively, in some embodiments the adaptor is configured for reversibly attaching the butt stock to a handgun by reversibly mating with a mating component that is separately attached to the handgun.

BRIEF DESCRIPTION OF THE FIGURES

Some embodiments of the invention are herein described with reference to the accompanying figures. The description, together with the figures, makes apparent to a person having ordinary skill in the art how some embodiments of the invention may be practiced. The figures are for the purpose of illustrative discussion and no attempt is made to show structural details of an embodiment in more detail than is necessary for a fundamental understanding of the invention. For the sake of clarity, some objects depicted in the figures may not be to scale.

In the Figures.

DESCRIPTION OF SOME EMBODIMENTS OF THE INVENTION

Figure 1A:
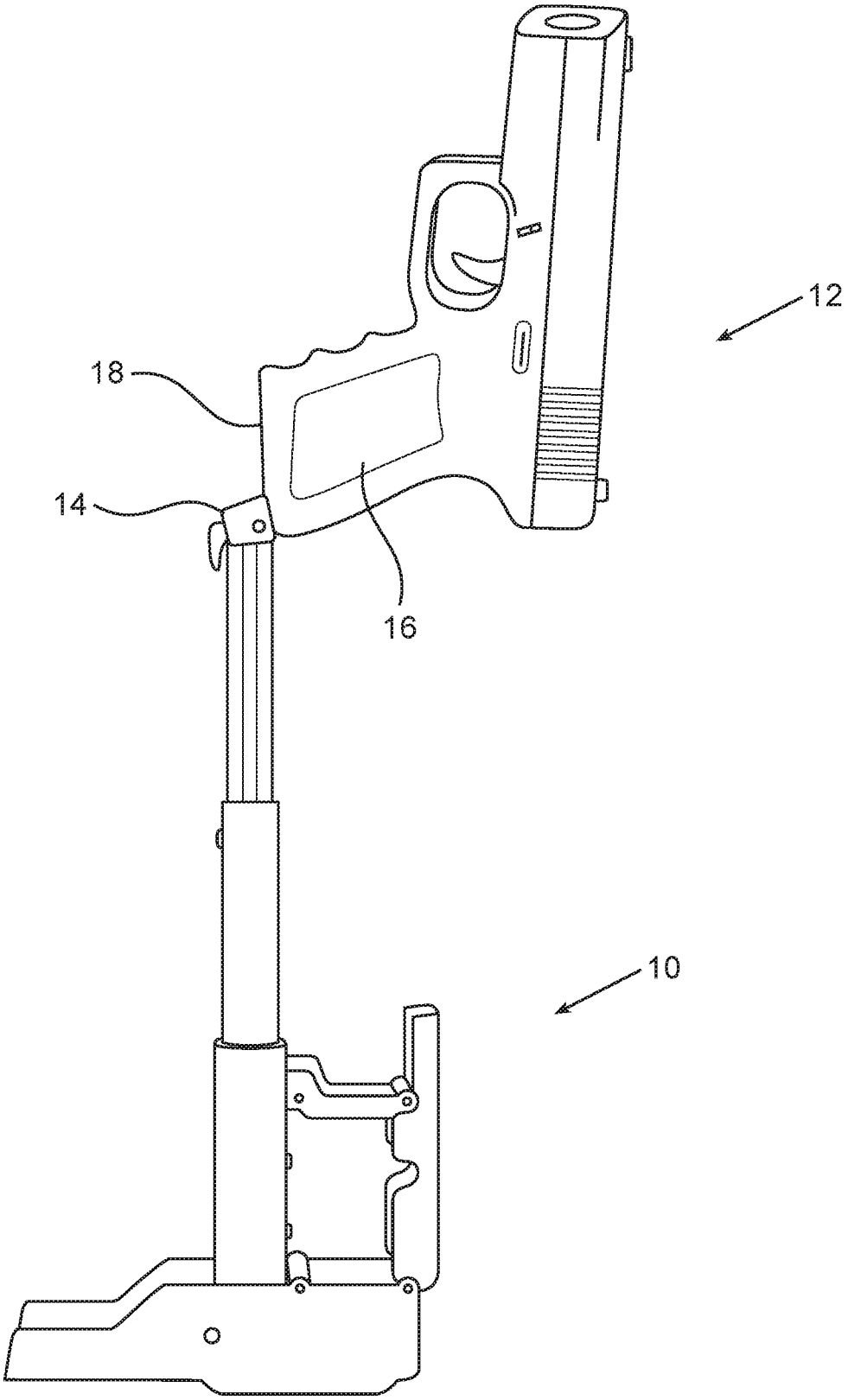
FIG. 1 depict an exemplary embodiment of a butt stock according to the teachings herein in FIG. 1A in a deployed state attached to a handgun, in FIG. 1B in a deployed state held for use in hand-to-hand combat, in FIG. 1C in a compact state held for use as a hammer, for example, for breaking a glass window and in FIG. 1D in an intermediate state (where the quadrilateral assembly is in a closed position and the telescopic assembly is in an at least partially extended conformation) for use as a hammer, for example for breaking a glass window.

Some embodiments of the invention relate to a butt stock that is reversibly attachable to a handgun, the butt stock having a compact state and a deployed state. The butt stock is relatively compact when in the compact state, but when attached to a handgun in a deployed state may provide multiple points of contact for a user of the handgun that potentially increase the accuracy of the handgun. In the compact state the butt stock is relatively compact, in some but not all embodiments sufficiently compact to fit in a conventional pistol magazine pouch.

In some, but not all, embodiments, the butt stock is easily attachable to a handgun, even under tactical conditions. In some, but not all, embodiments, the butt stock is easily deployable, that is to say, the butt stock can easily be changed from the compact state to the deployed state. In some, but not all, embodiments, the butt stock is easily detachable from a handgun, especially under tactical conditions. In some, but not all, embodiments, the butt stock can easily be changed from the deployed state to the compact state.

As used herein, the term tactical conditions is as understood by a person having ordinary skill in the art and typically includes conditions where a user of the butt stock is under time constraints, possibly under conditions of limited visibility (e.g., dark), must maintain situational awareness including paying attention to electronic, verbal or gesture communications, is possibly moving or taking cover and may be under fire or believing that there is an imminent possibility of being under fire.

The principles, uses and implementations of the teachings of the invention may be better understood with reference to the accompanying description and figures. Upon perusal of the description and figures present herein, one skilled in the art is able to implement the teachings of the invention without undue effort or experimentation. In the figures, like reference numerals refer to like parts throughout.

Before explaining at least one embodiment of the invention in detail, it is to be understood that the invention is not necessarily limited in its application to the details of construction and the arrangement of the components and/or methods set forth herein. The invention is capable of other embodiments or of being practiced or carried out in various ways. The phraseology and terminology employed herein are for descriptive purpose and should not be regarded as limiting.

A preferred exemplary embodiment of a butt stock according to the teachings herein is depicted in the Figures.

In FIG. 1A, an embodiment of a butt stock 10 according to the teachings herein is depicted in a deployed state attached to an exemplary handgun 12 (a Glock 19) through an adaptor 14 that reversibly locks into a gap in a grip 16 of handgun 12 just behind a magazine well 18, similar to an adaptor used in the commercially-available GLR-17 or GLR-440 tactical stocks (FAB Ltd., Modi'in, Israel).

Figure 1B:
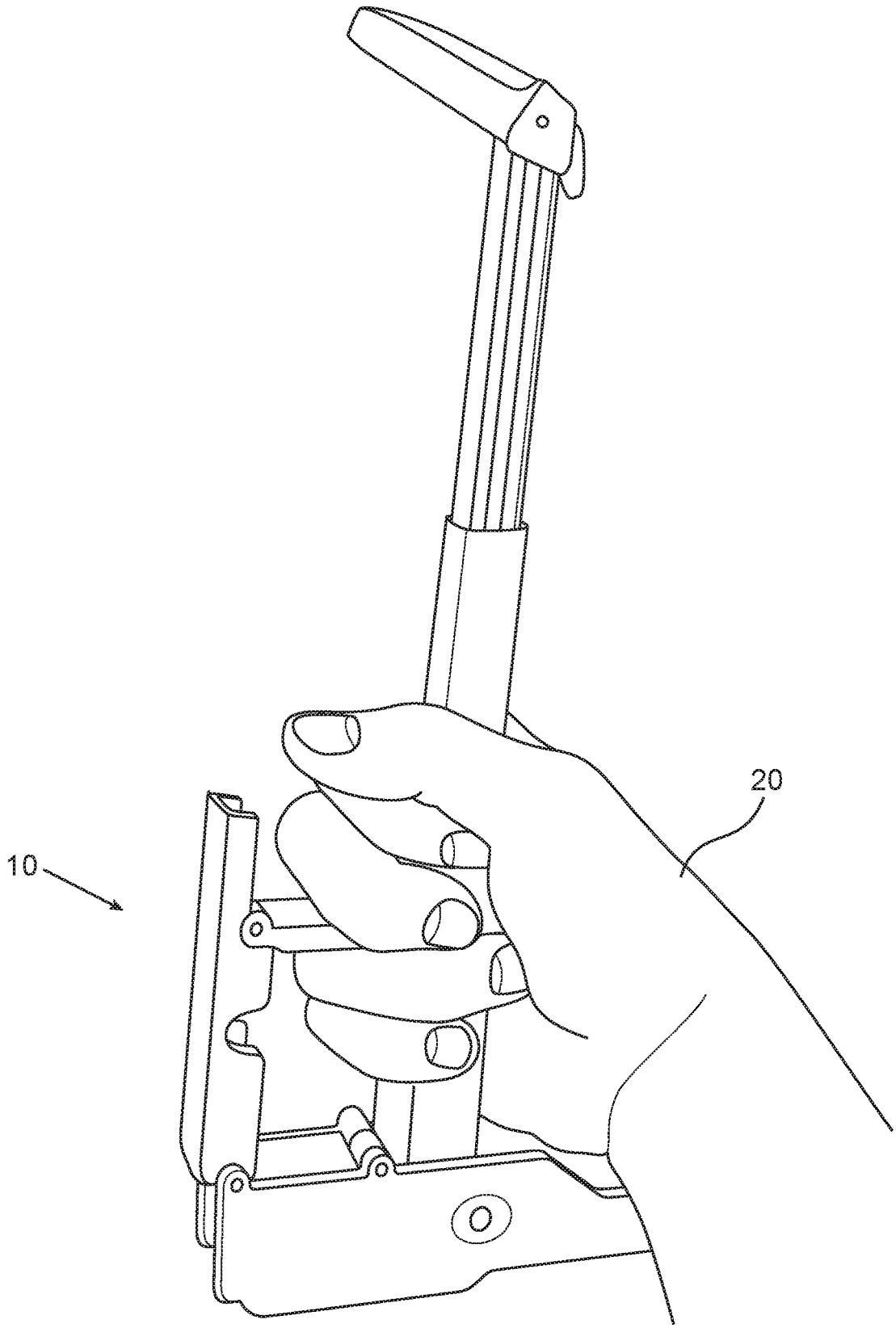

In FIG. 1B, butt stock 10 is depicted in a deployed state, held in a hand 20 of a user for use in hand-to-hand combat in a manner analogous to brass knuckles.

Figure 1C:
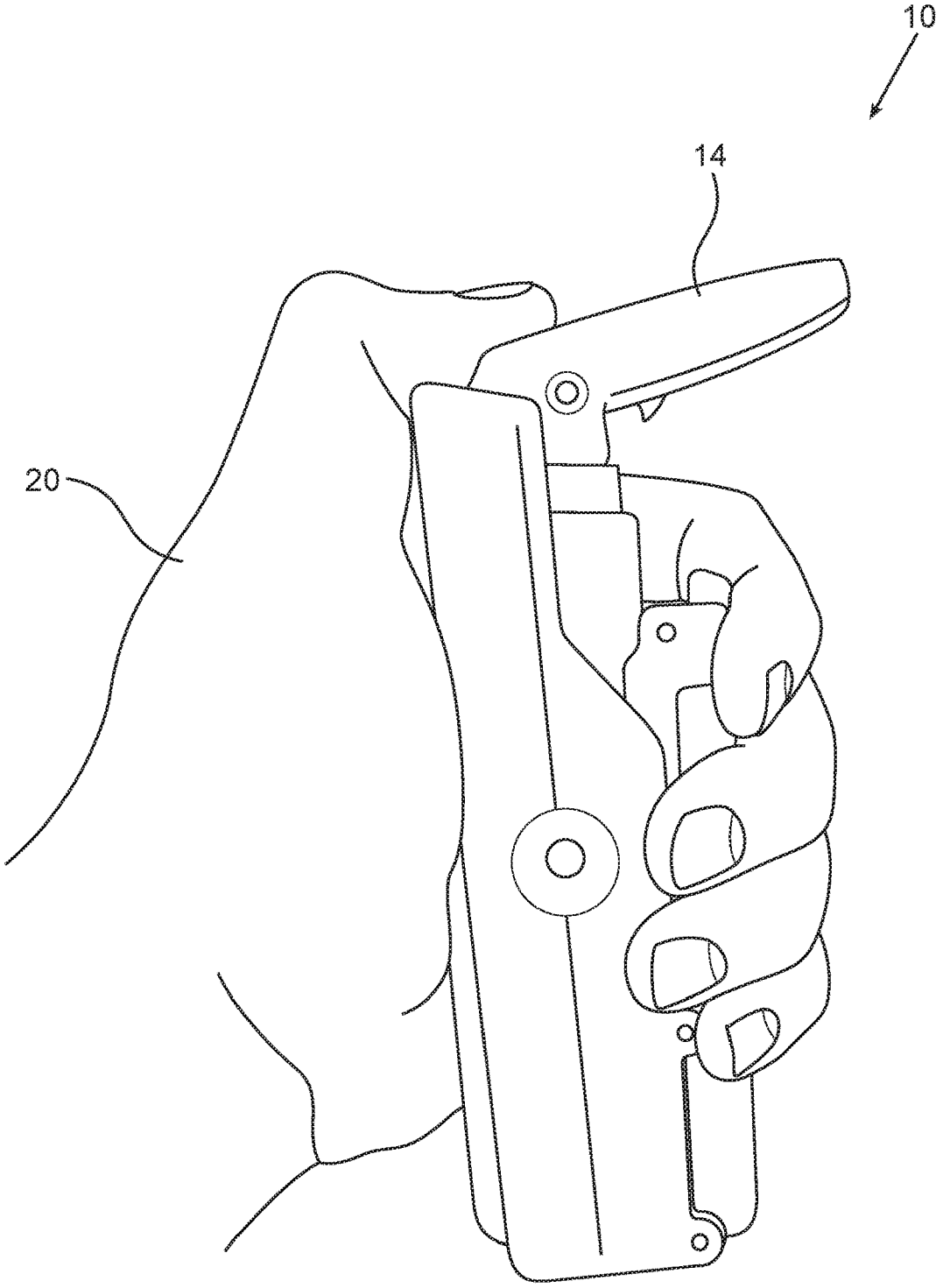

In FIG. 1C, butt stock 10 is depicted in a compact state, held in hand 20 for use as a hammer, for example, for breaking a glass window.

Figure 1D:
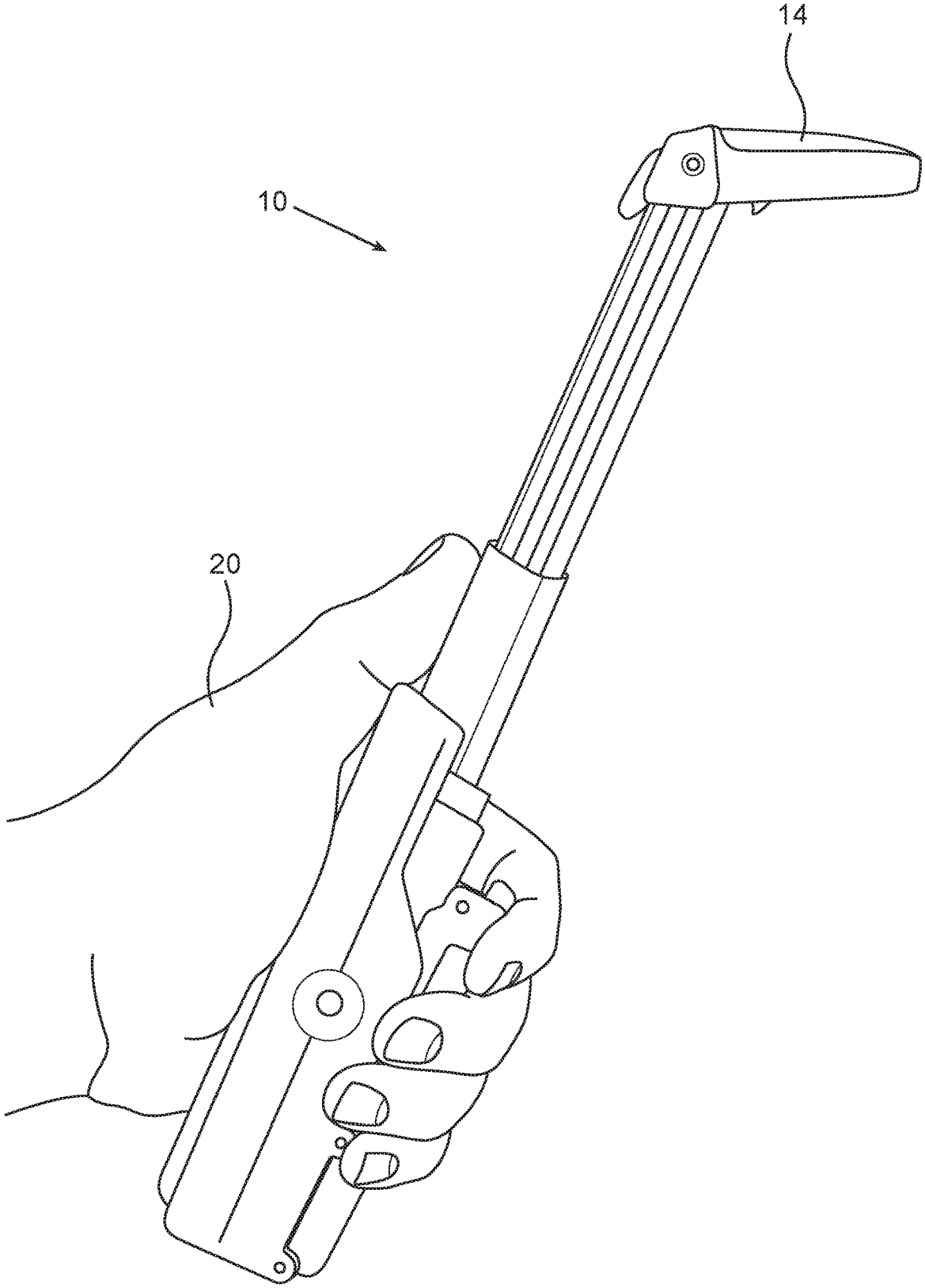

In FIG. 1D, butt stock 10 is depicted in an intermediate state (where the quadrilateral assembly is in a closed position and the telescopic assembly is in an at least partially extended conformation) for use as a hammer, for example for breaking a glass window.

Figure 2A:
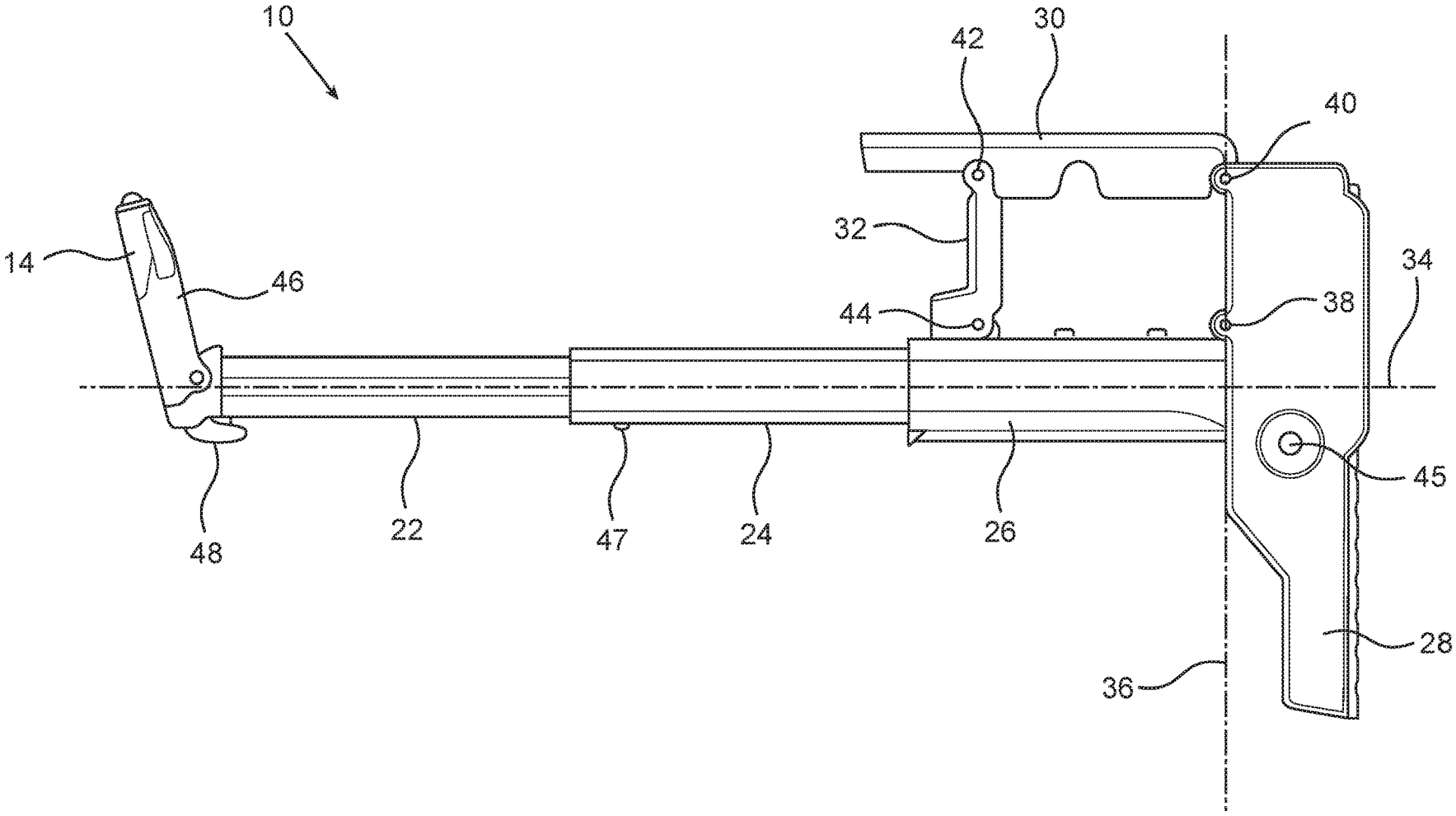
FIGS. 2A-2U schematically depict the exemplary embodiment of a butt stock according to the teachings herein in various views during various steps of changing from a deployed state to a compact state.
Figure 2B:
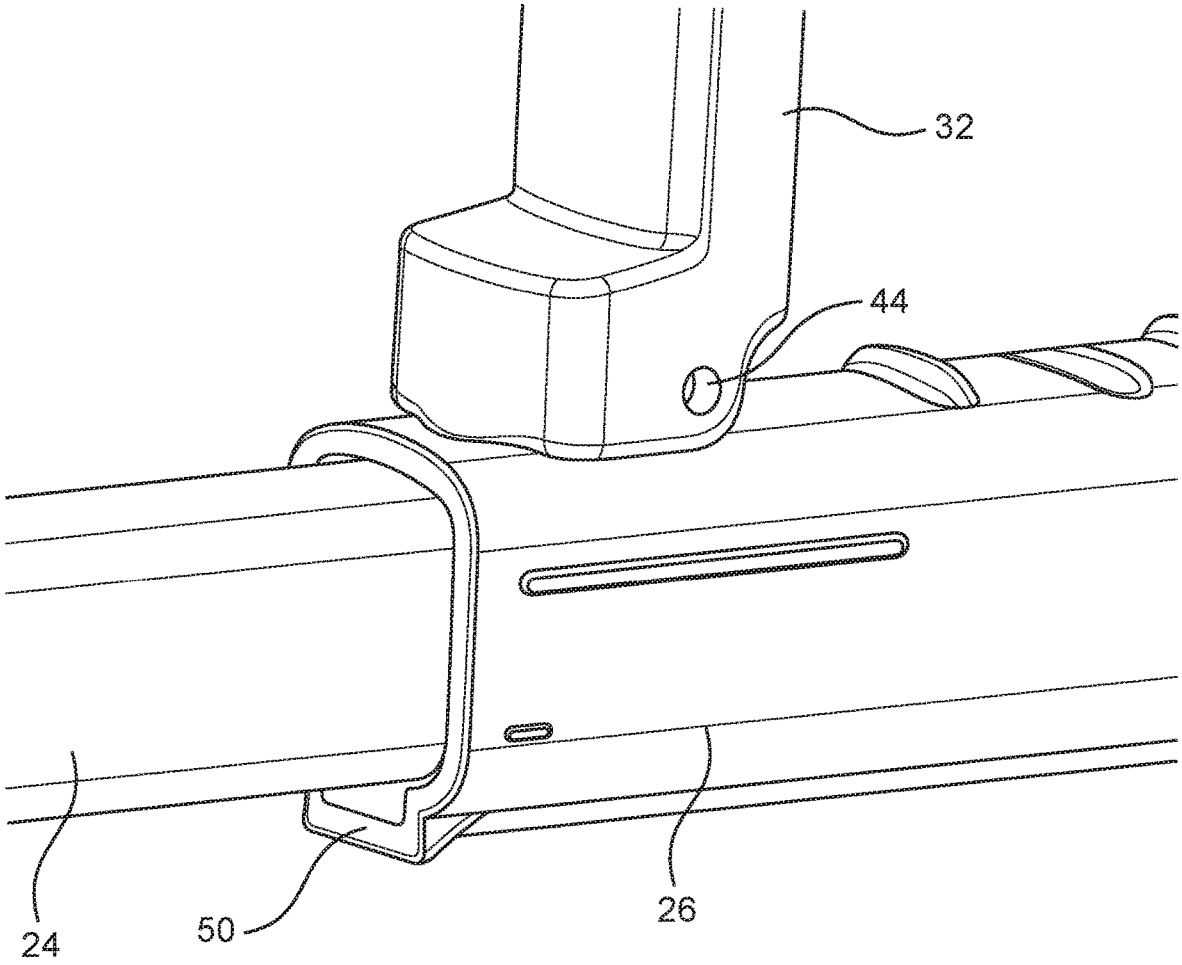
Figure 2C:
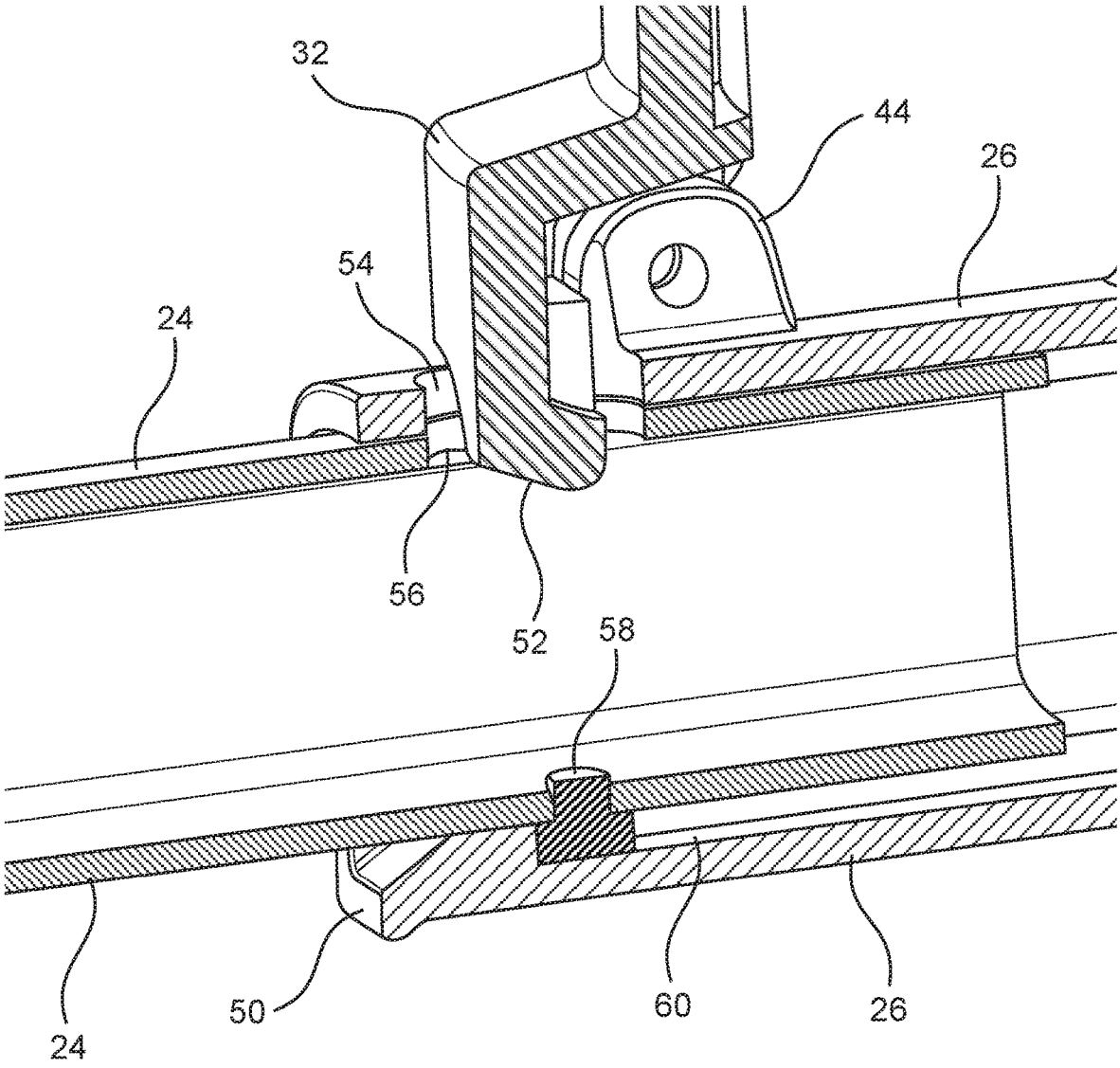
Figure 2D:
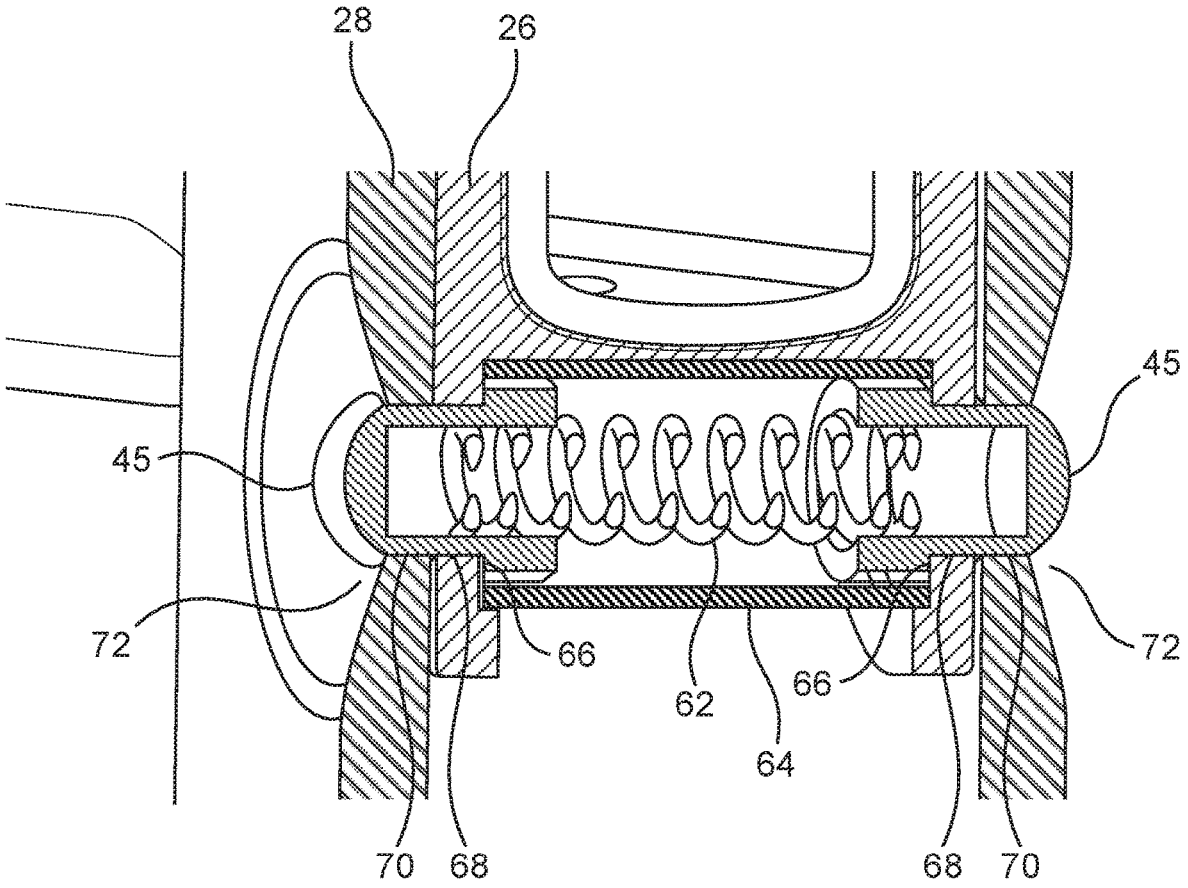
Figure 2E:
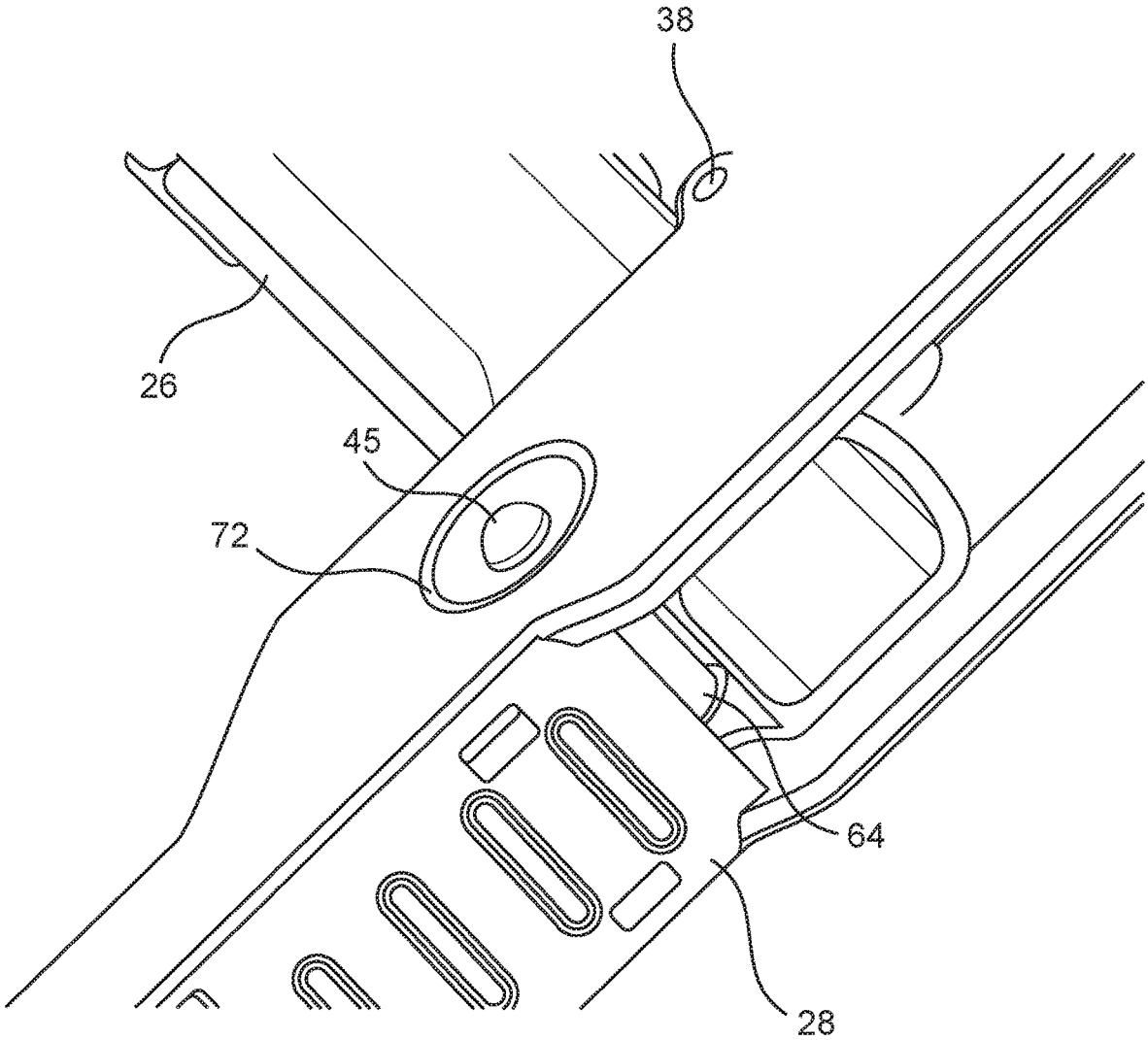
Figure 2F:
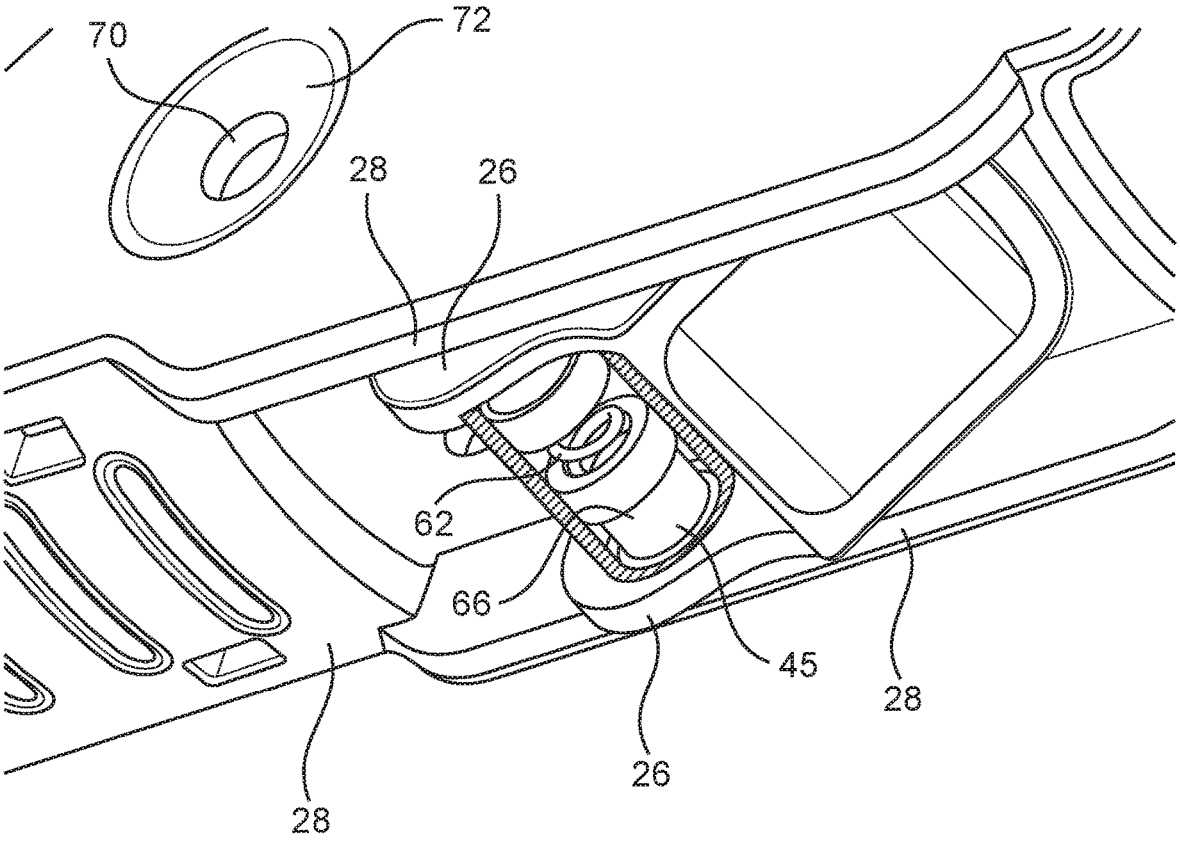
Figure 2G:
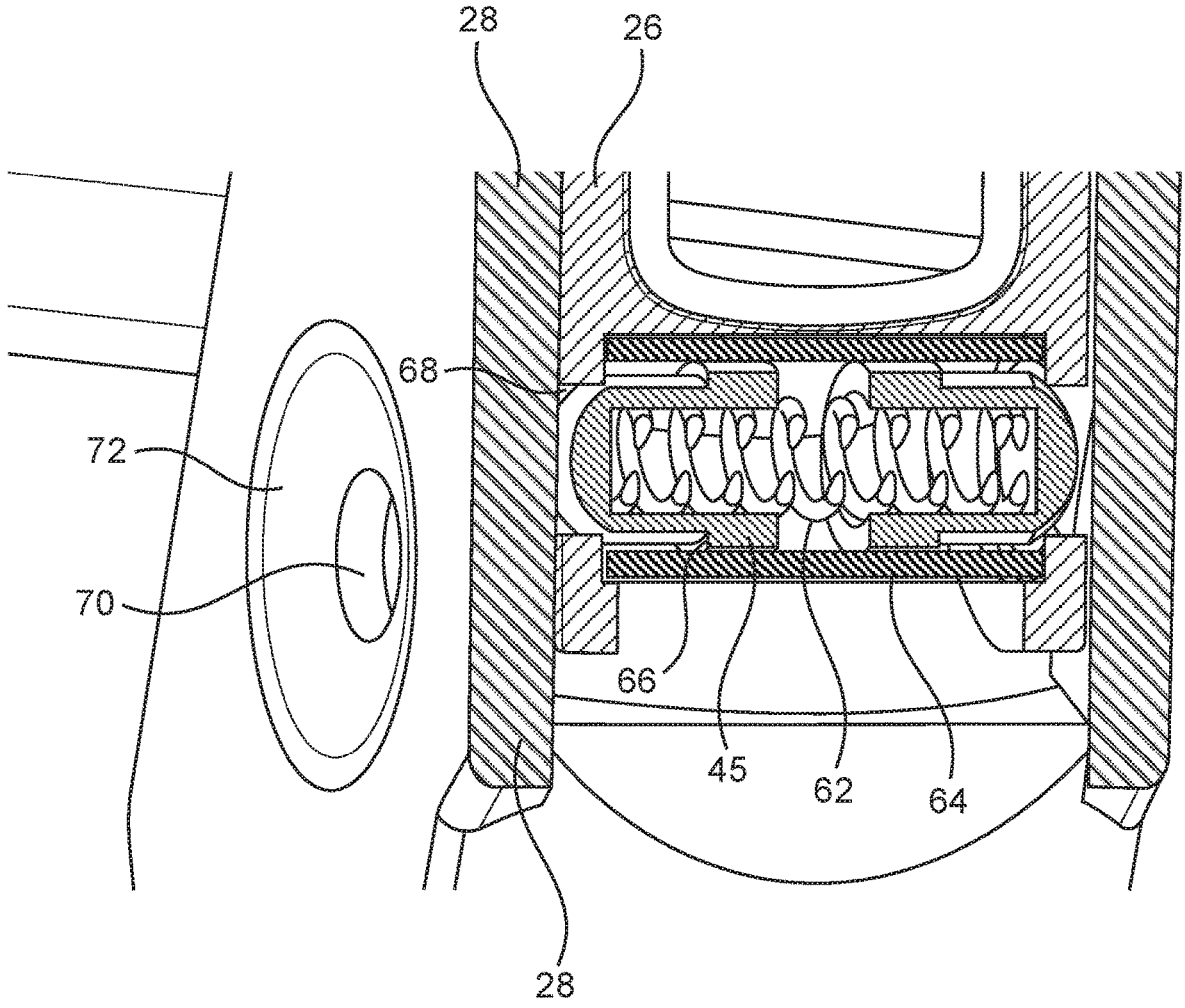
Figure 2H:
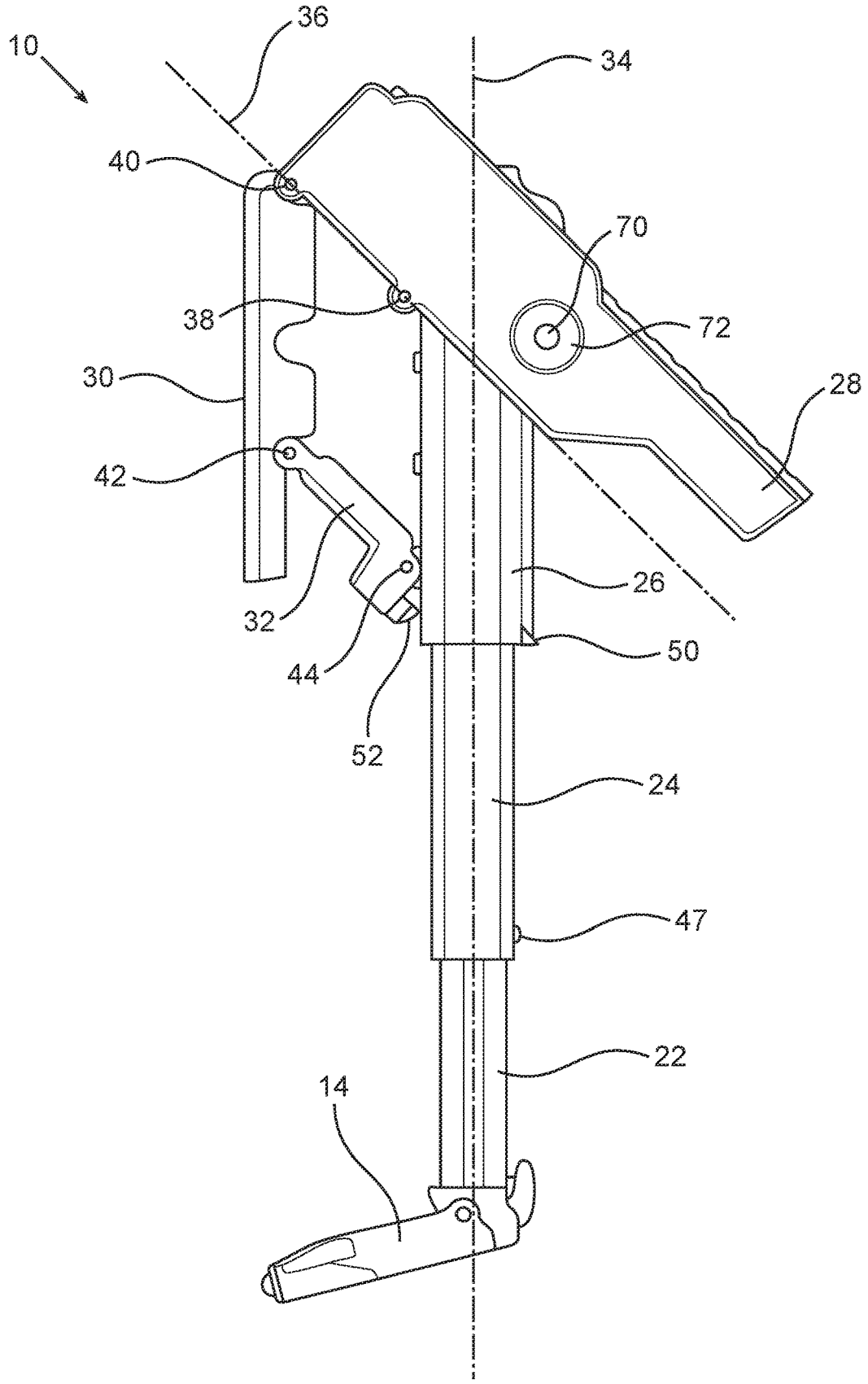
Figure 2I:
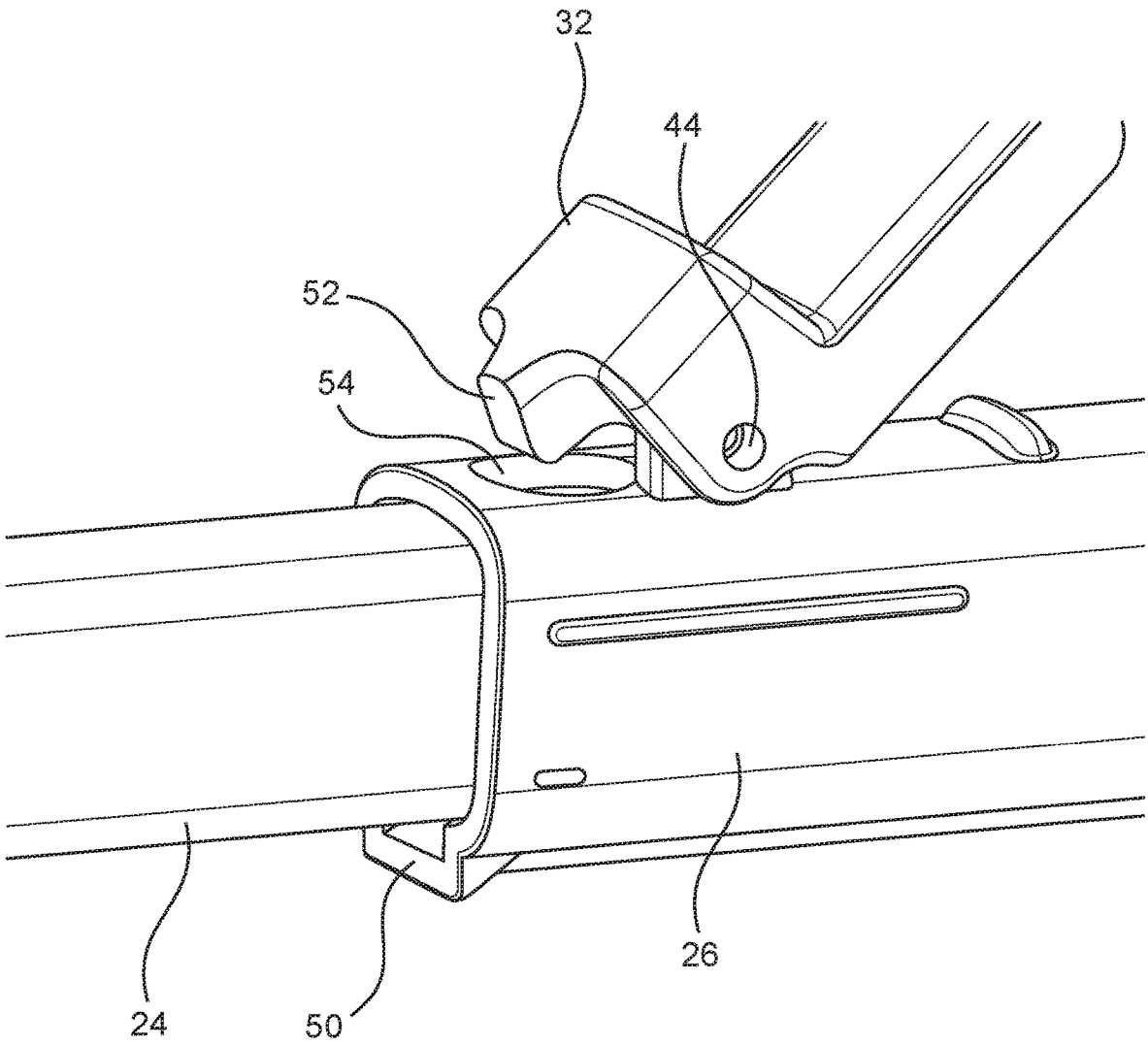
Figure 2J:
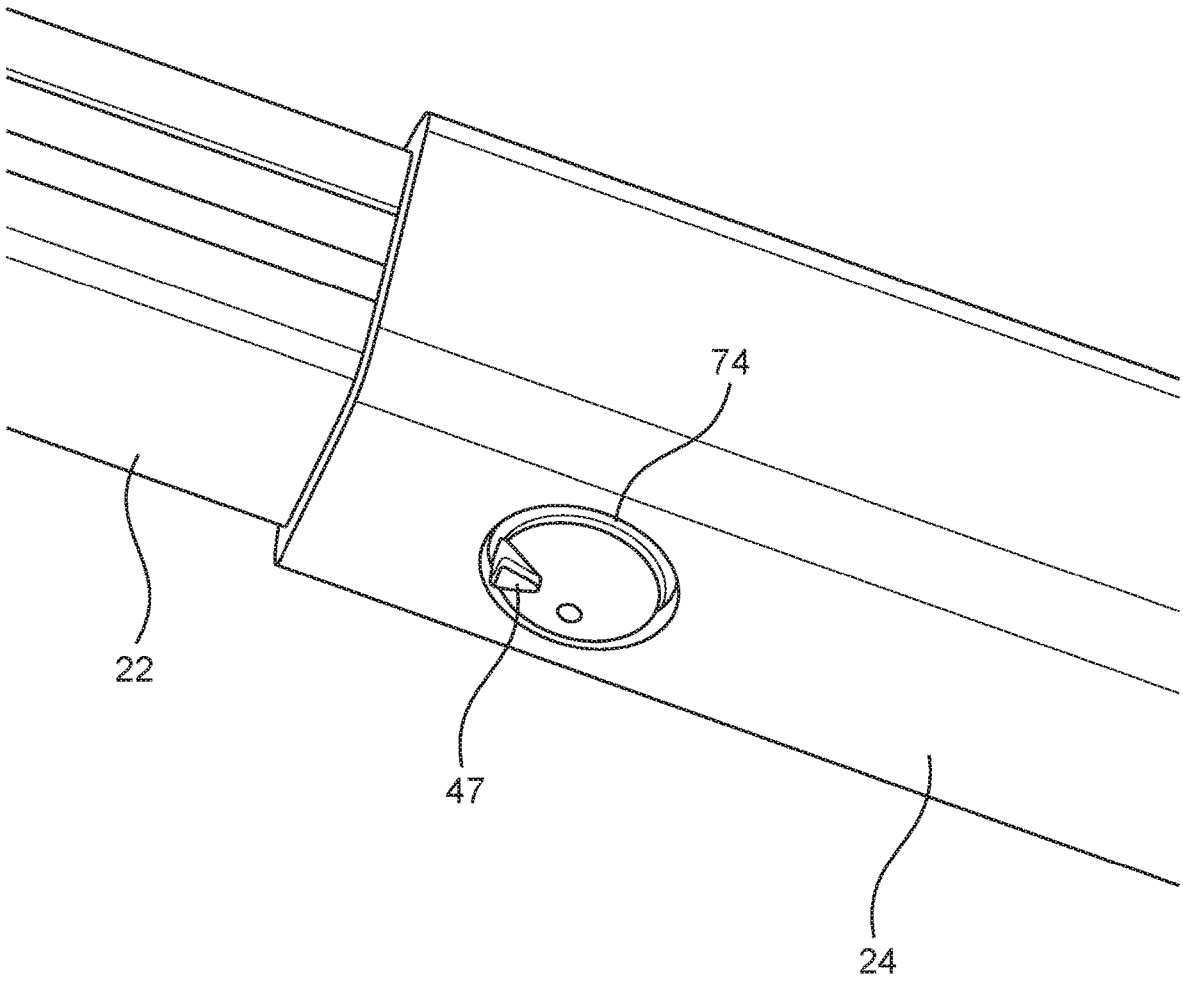
Figure 2K:
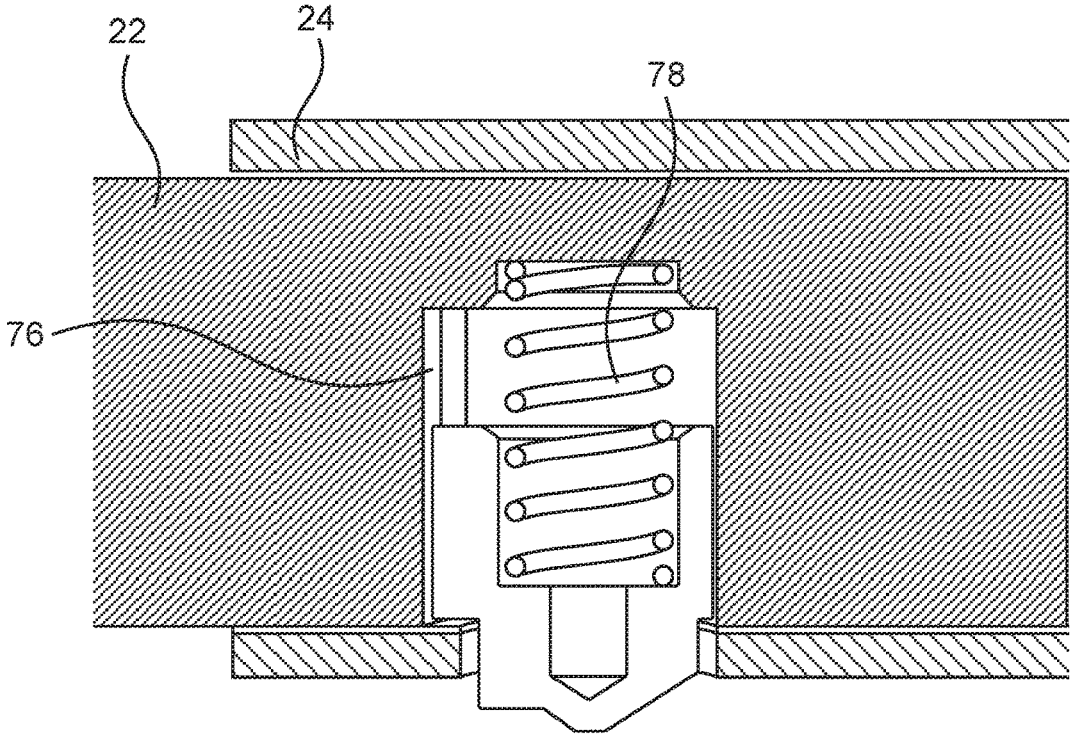
Figure 2L:
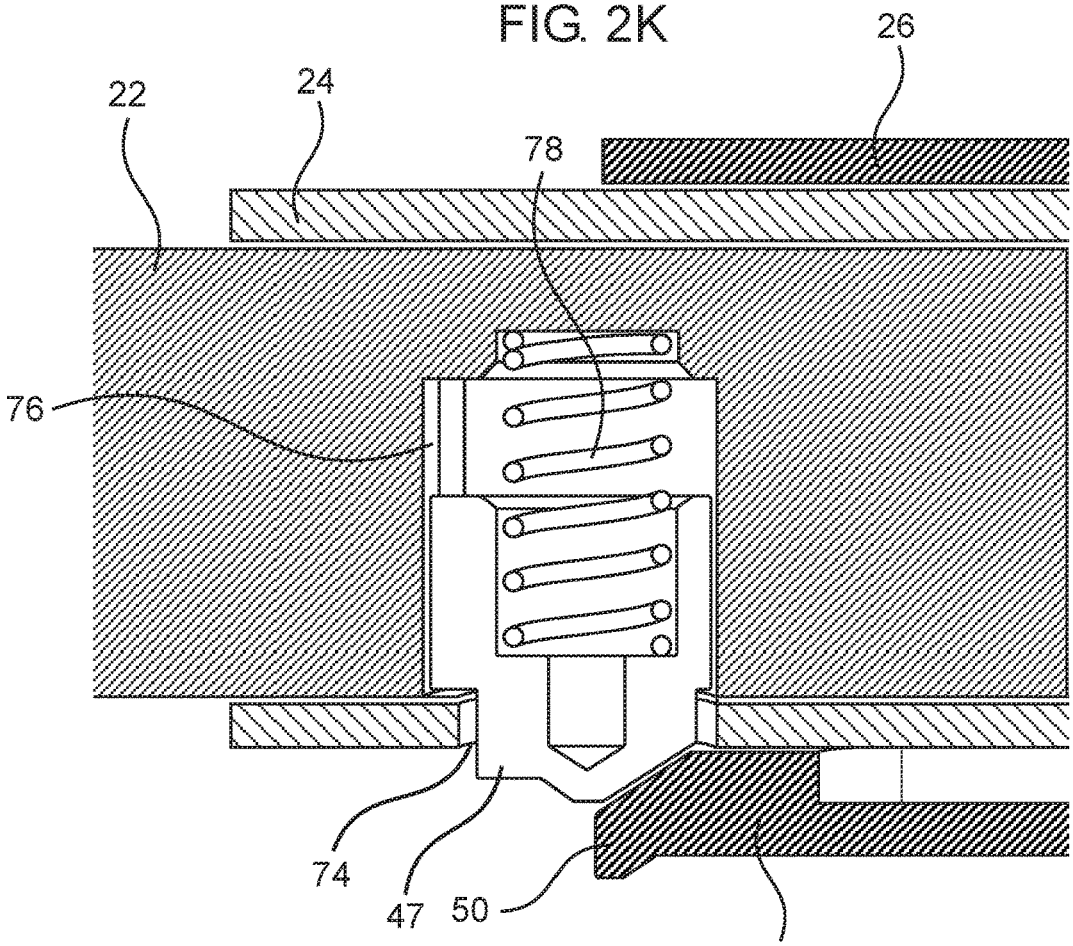
Figure 2M:
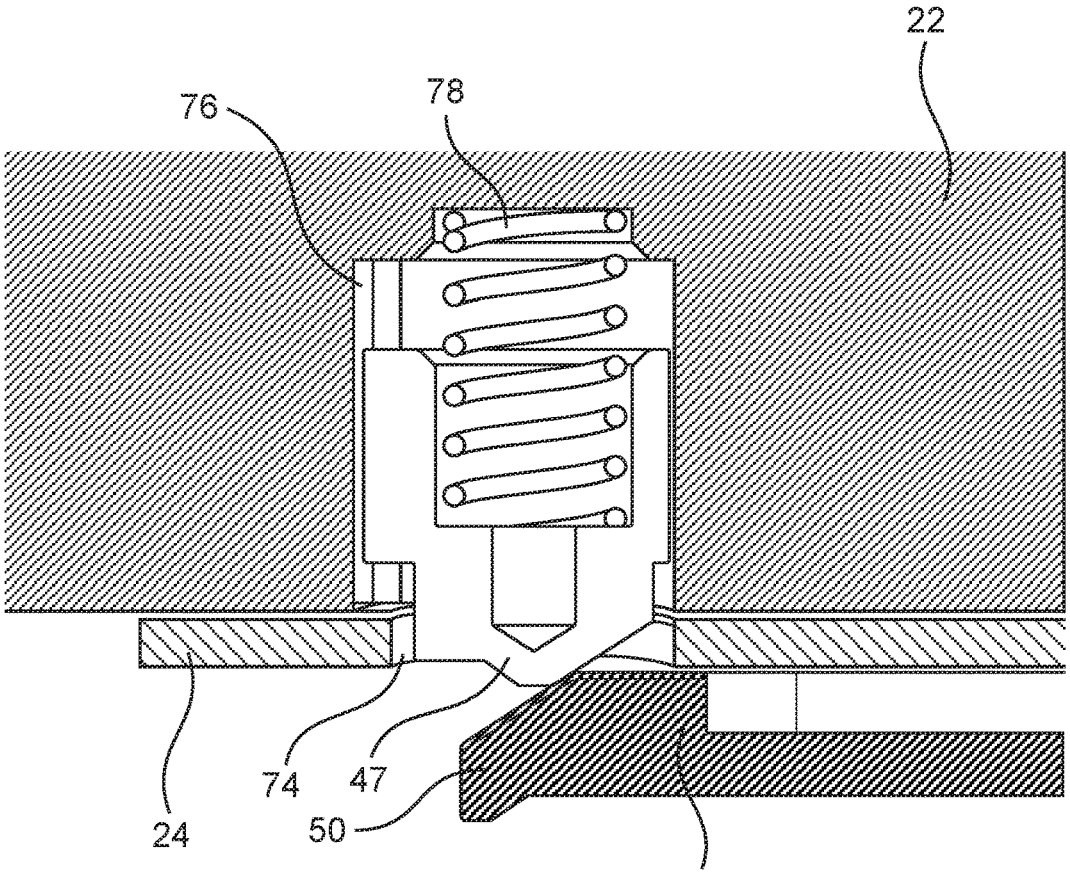
Figure 2N:
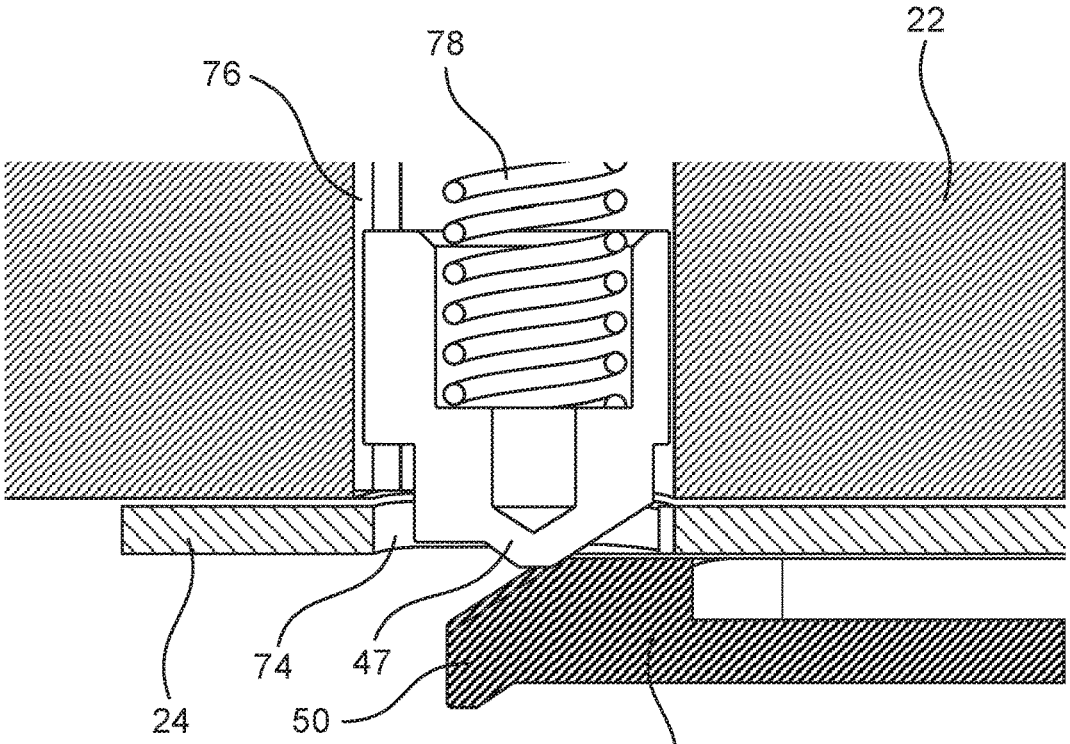
Figure 2O:
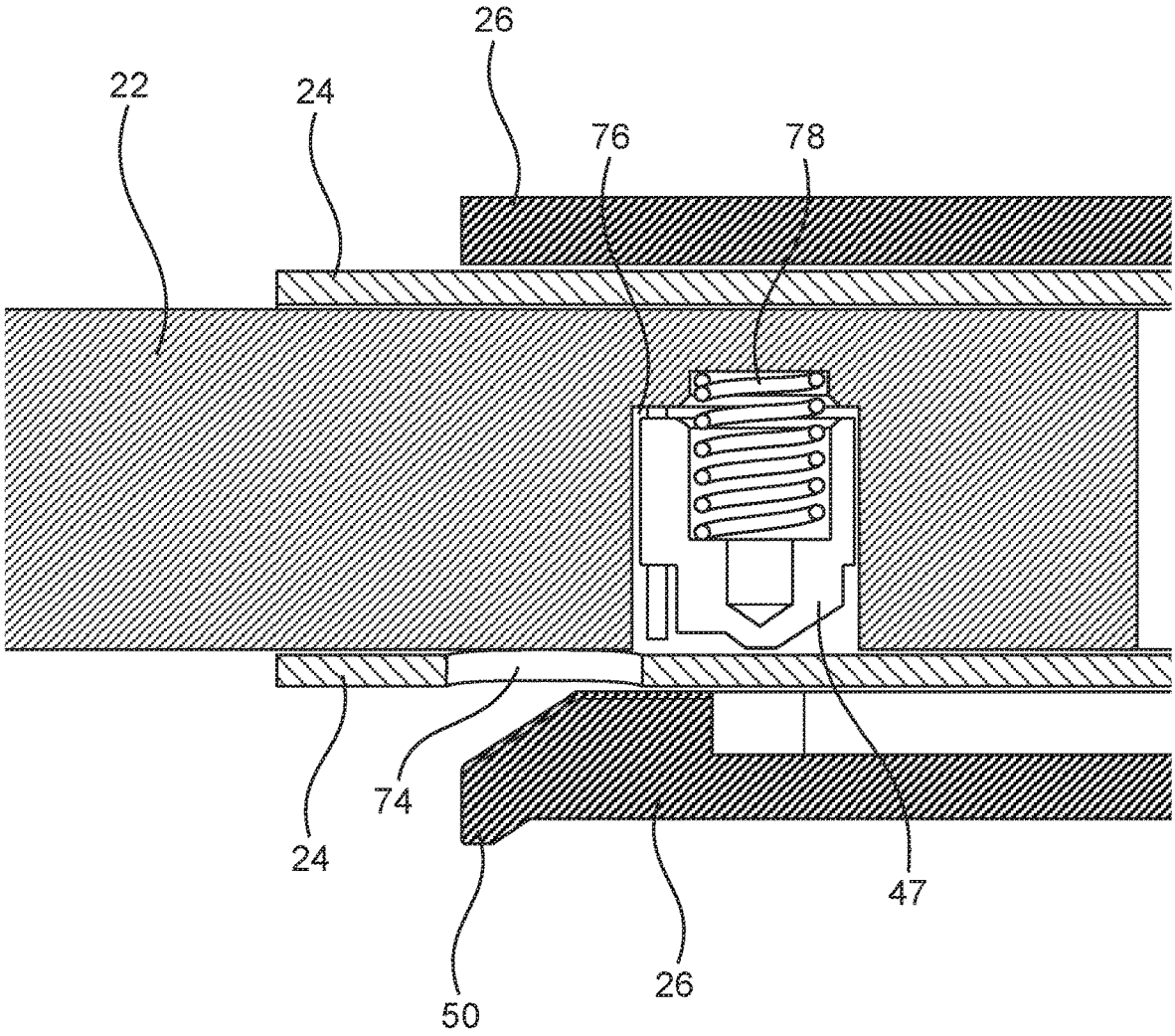
Figure 2P:
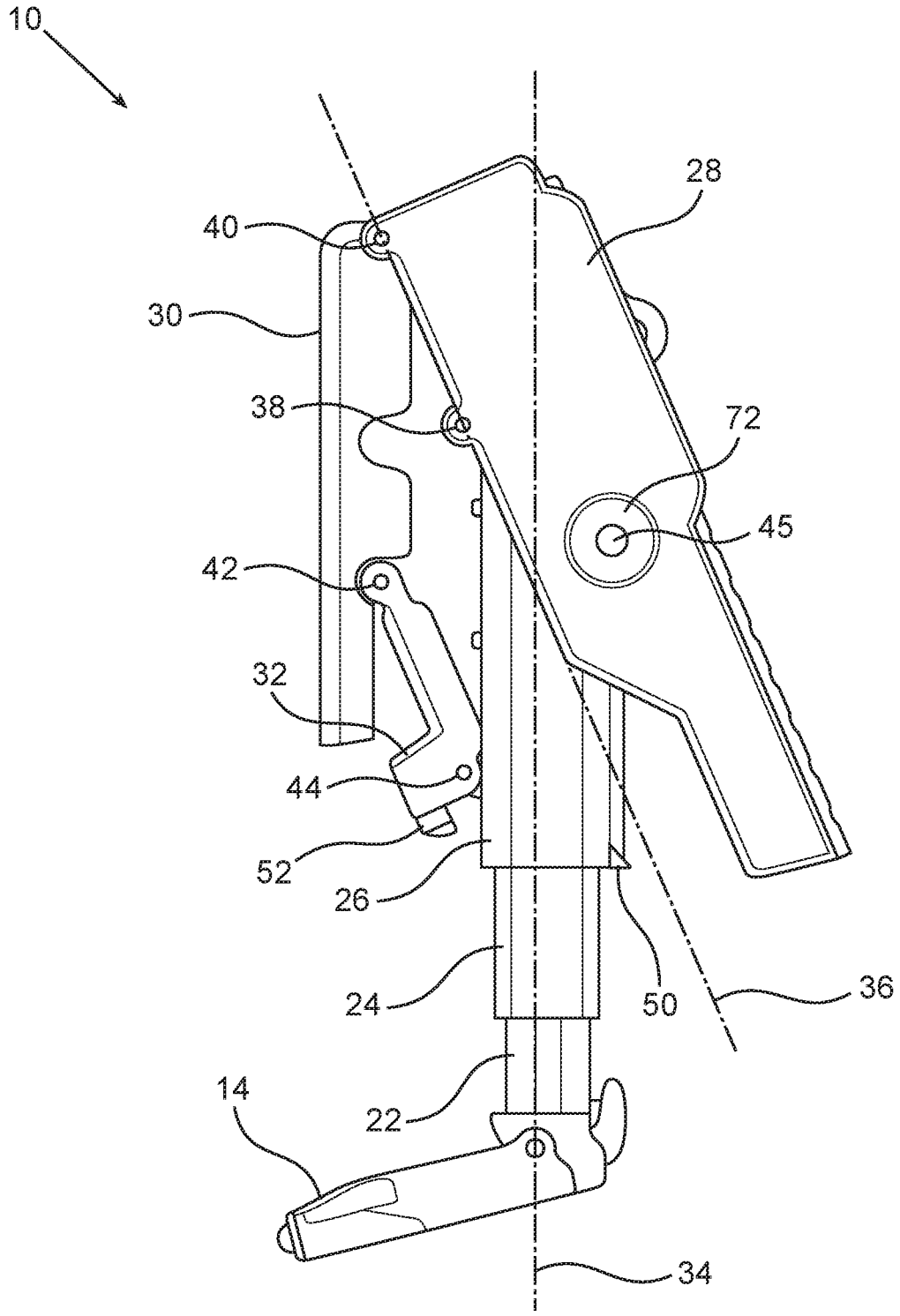
Figure 2Q:
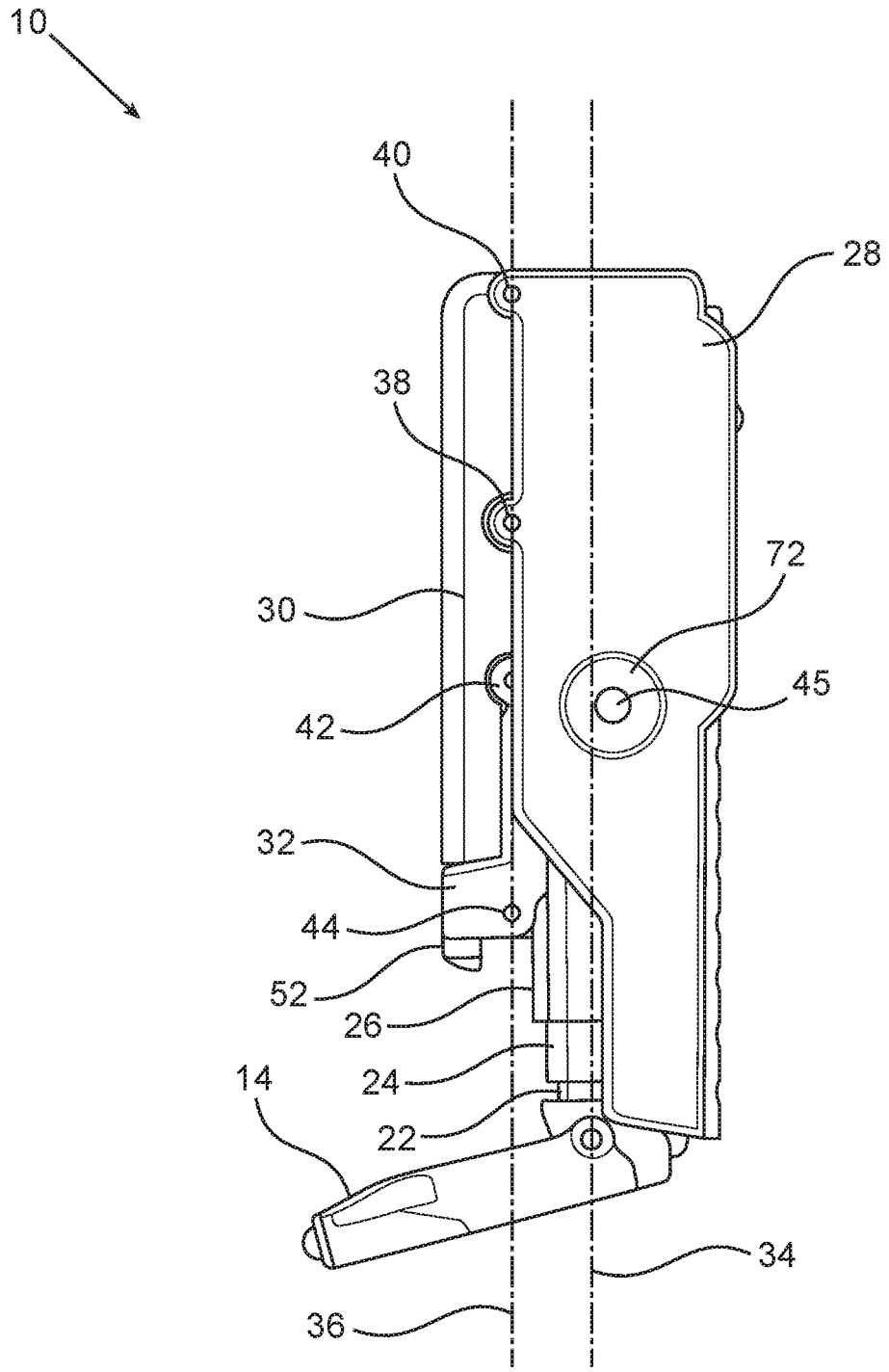
Figure 2R:
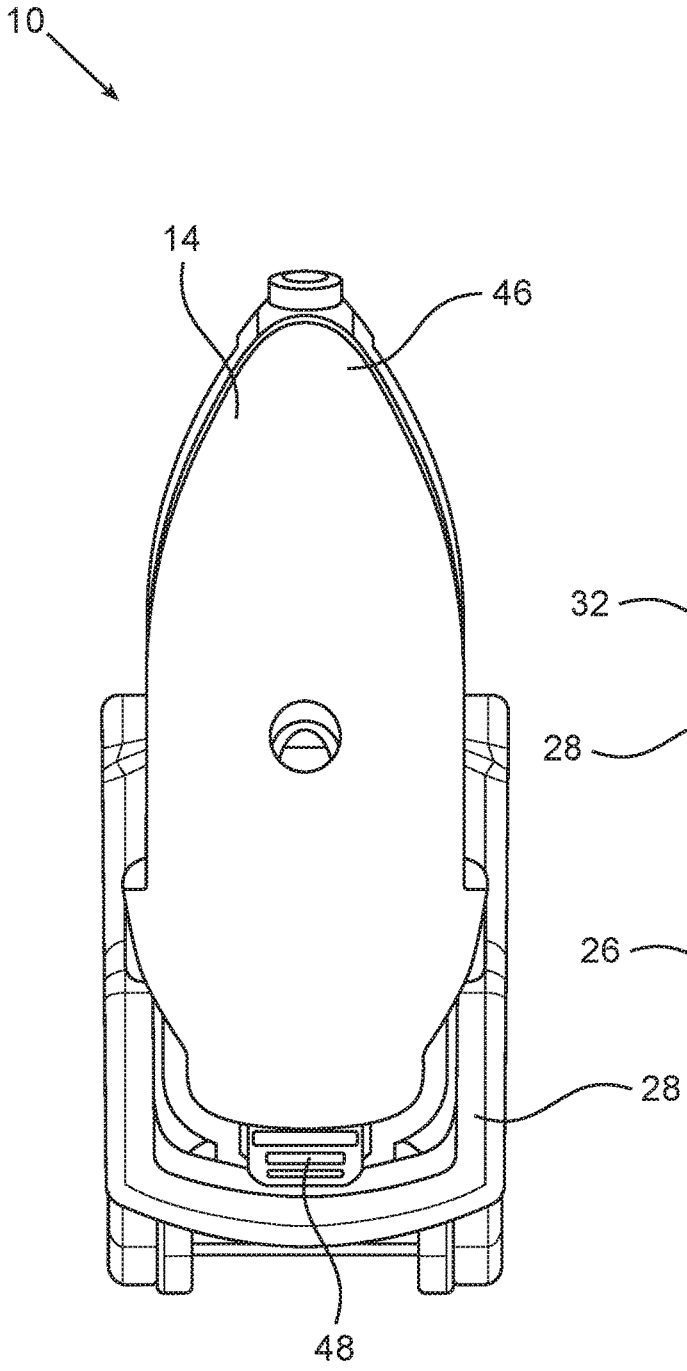
Figure 2S:
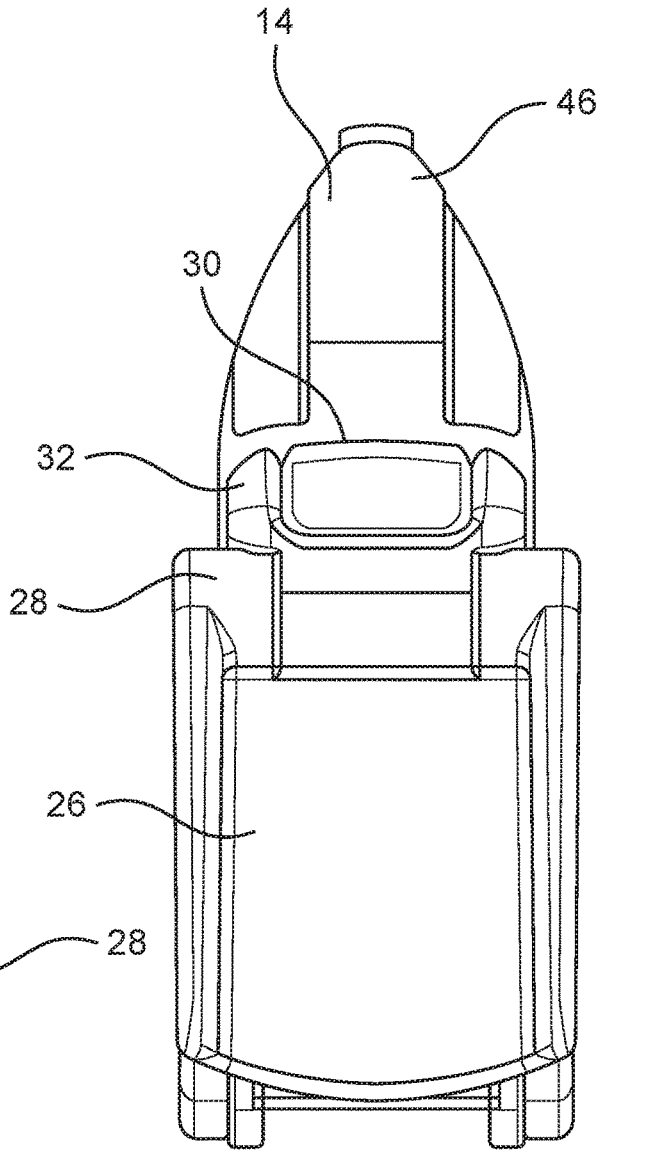
Figure 2T:
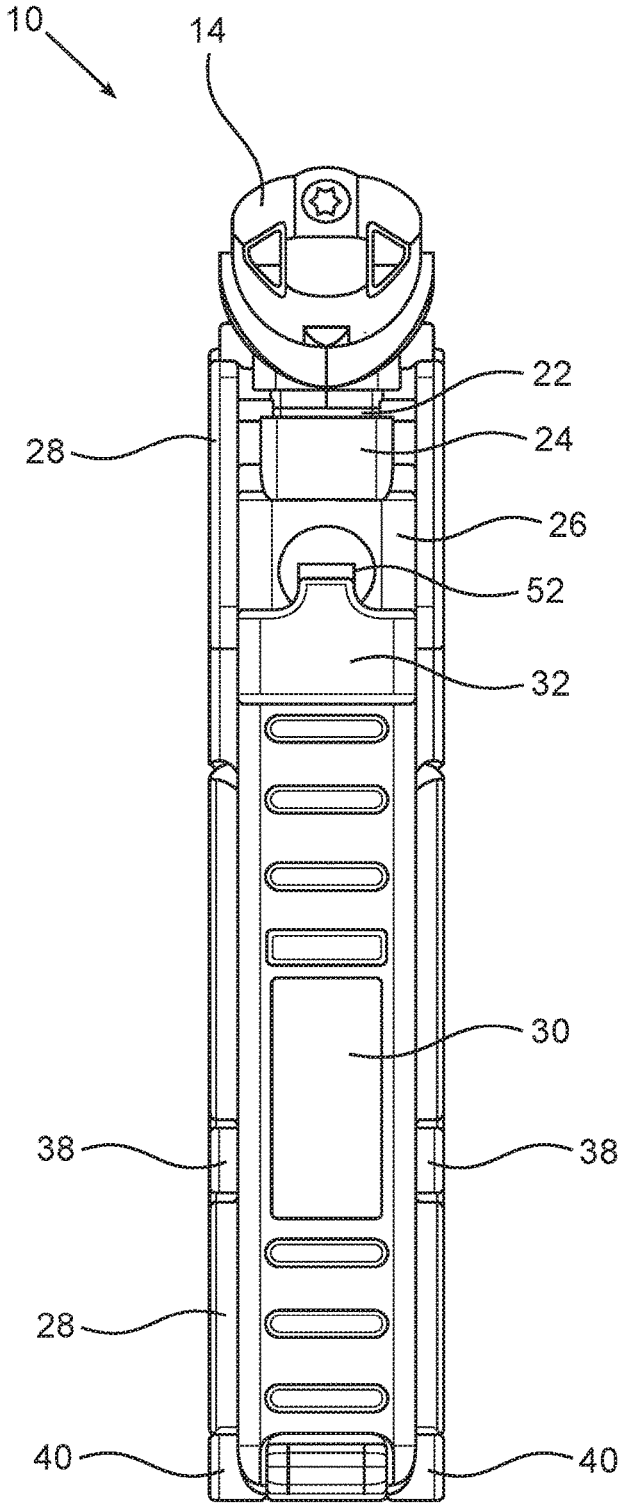
Figure 2U:
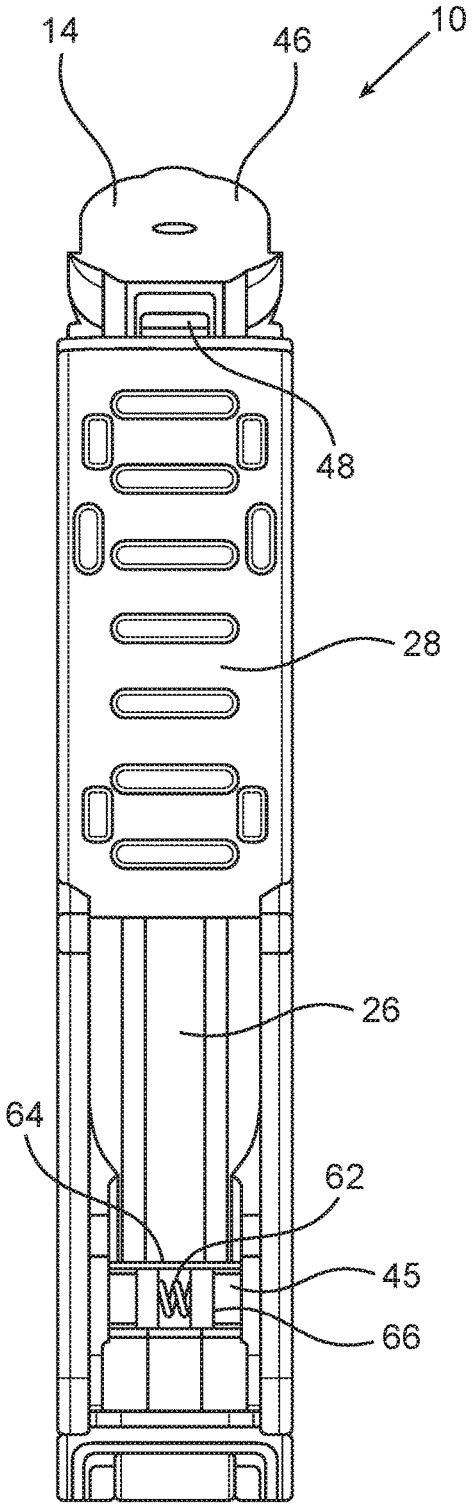

FIGS. 2A-2U schematically depict various views of butt stock 10 during the process of changing from the deployed state depicted in FIGS. 1A and 1B to the compact state as depicted in FIG. 1C.

FIG. 2A: Deployed State

In FIG. 2A, collapsible butt stock 10 is depicted in the deployed state. From left (distal) to right (proximal) are seen adaptor 14, a distal bar 22, a hollow middle bar 24, a hollow proximal bar 26 and a butt 28. Connected to butt 28 is a cheek rest 30. Linking cheek rest 30 to proximal bar 26 is a locking bar 32.

An imaginary telescoping axis 34 passes through the centers of distal bar 22, middle bar 24 and proximal bar 26. Distal bar 22 is configured to telescopically slide into the hollow of middle bar 24 and middle bar 24 is configured to telescopically slide into the hollow of proximal bar 26 along telescoping axis 34.

Telescoping axis 34 and an imaginary butt axis 36 are included in and define a vertical plane of butt stock 10 which substantially bisects the above-listed physical components. When butt stock 10 is in the deployed state, butt axis 36 is perpendicular to telescoping axis 34.

Proximal bar 26 is connected to butt 28 through a hinge 38 allowing rotation of proximal bar 26 relative to butt 28 around the rotation axis of hinge 38 which rotation axis is perpendicular to the vertical plane. Butt 28 defines a hollow in which the proximal end of proximal bar 26 is held, proximal bar 26 having a width dimension (parallel to the rotation axis of hinge 38) that is smaller than the hollow of butt 28. Further, the rotation axis of hinge 38 is offset distally from the proximal end of butt 28 by a distance that is at least a little greater than the height of proximal bar 26, the height being the dimension perpendicular to telescoping axis 34 and the rotation axis of hinge 38. As a result and as discussed in greater detail below, when proximal bar 26 is rotated around hinge 38 during a change of butt stock 10 from a deployed state to a compact state (proximal bar 26 moving counter clockwise relative to butt axis 36 in FIG. 2A), proximal bar 26 enters the hollow of butt 28.

A proximal end of cheek rest 30 is connected to butt 28 through a hinge 40 allowing rotation of check rest 30 relative to butt 28 around the rotation axis of hinge 40 that is perpendicular to the vertical plane. As noted above, butt 28 defines a hollow in which the proximal end of cheek rest 30 is held, cheek rest 30 having a width dimension (parallel to the rotation axis of hinge 40) that is smaller than the hollow of butt 28, An upper end of locking bar 32 is connected to cheek rest 30 through a hinge 42 allowing rotation of locking bar 32 relative to cheek rest 30 around a rotation axis of hinge 42 perpendicular to the vertical plane. Cheek rest 30 defines a hollow in which an upper end of locking bar 32 is held, locking bar 32 having a width dimension (parallel to the rotation axis of hinge 42) that is smaller than the hollow of locking bar 32.

A lower end of locking bar 32 is connected to proximal bar 26 through a hinge 44 allowing rotation of locking bar 32 relative to proximal bar 26 around a rotation axis of hinge 44 perpendicular to the vertical plane.

Proximal bar 28, hinge 38, butt 28, hinge 40, cheek rest 30, hinge 42, locking bar 32 and hinge 44 together define a planar quadrilateral four-bar linkage which is a planar parallelogram four-bar linkage where the length of opposing linkages is the same, i.e., the distance between the axes of hinges 38-40 is equal to the distance between the axes of hinges 42-44 and the distance between the axes of hinges 40-42 is equal to the distance between the axes of hinges 38-40.

The head of a rotation locking pin 45 is seen on the side of butt 28 which function is discussed in detail hereinbelow. The head of a telescoping locking pin 47 is seen protruding from the bottom of middle bar 24 near the distal end thereof, which function is discussed in detail hereinbelow.

In FIG. 2A, adaptor 14 is seen from the side, comprising a locking head 46 and a release button 48. As noted above, adaptor 14 is similar or identical to an adaptor used in commercially-available GLR-17 or GLR-440 tactical stocks (FAB Ltd., Modi'in, Israel). For attaching butt stock 10 to a Glock 19 handgun, locking head 46 is pushed into the gap behind the magazine well of the handgun. Locking head 46 is biased to a locking position so, when pushed fully into the gap, locks into place. To separate butt stock 10 from a handgun, a user presses release button 48 so that locking head 46 is in a released confirmation and is easily pulled out of the gap.

FIG. 2B

In FIG. 2B, the intersection of middle bar 24, proximal bar 26 and locking bar 32 around hinge 44 is shown in greater detail. Also seen in FIG. 2B is a guide lip 50 that will be discussed in detail hereinbelow.

FIG. 2C

In FIG. 2C, a cut-out view of the intersection of middle bar 24, proximal bar 26 and locking bar 32 is depicted.

In FIG. 2C it is seen how locking bar 32 is attached to proximal bar 26 with a hinge 44 which limits the movement of locking bar 32 relative to proximal bar 26 to only rotation around the axis of hinge 44 in the vertical plane.

Also seen in FIG. 2C is that in the deployed state of butt stock 10, a locking tooth 52 which is an integrally formed portion of locking bar 32 passes through a distal gap 54 in the top of proximal bar 26 and a proximal gap 56 in the top of middle bar 24. Locking tooth 52 thereby locks the relative position of proximal bar 26 to middle bar 24 and prevents telescopic contraction of middle bar 24 into the hollow of proximal bar 26 when butt stock 10 is in an open position.

Also seen in FIG. 2C is a slide pin 58 attached to and protruding from middle bar 24 into a groove 60 in the bottom inner face of proximal bar 26: slide pin 58 is configured to snugly fit in groove 60, allowing telescopic motion (extension and contraction) along telescoping axis 34 of middle bar 24 into and out of proximal bar 26, but reducing or preventing rotational motion of middle bar 24 relative to proximal bar 26 around telescoping axis 34.

FIG. 2D

FIG. 2D is a cut-out view of the rotation-locking mechanism that prevents unwanted change of butt stock 10 from the deployed state to the compact state and collapse of the quadrilateral assembly from the open position to the closed position by preventing rotation around hinge 38 of proximal bar 26 relative to butt 28 unless the rotation-locking mechanism is released. The rotation-locking mechanism is fixed to proximal bar 26 and includes two opposing convex-headed rotation locking pins 45 outwardly biased with a coil spring 62, coil spring 62 and the two locking pins 45 held inside a retention tube 64 which inner bore is dimensioned to snugly slidingly contains locking pins 45 allowing axial sliding of locking pins 45. In the deployed state of butt stock 10, coil spring 62 pushes locking pins 45 outwards so that a ridge 66 of locking pins 45 is pressed against inner surfaces of proximal bar 26, through rotation locking holes 68 in proximal bar 26 and into rotation locking holes 70 in butt 28. The outer diameter of locking pins 45 and inner diameter of locking holes 68 and 70 are such that there is no substantial rotational motion of proximal bar 26 relative to butt 28 around hinge 38 when locking pins 45 are located inside locking holes 70 in butt 28. In the deployed state of butt stock 10, the convex heads of locking pins 45 pass through the walls of proximal bar 26 and butt 28 to protrude into recesses 72 in the outer side faces of butt 28 but do not protrude beyond the outer side faces of butt 28.

FIG. 2E

In FIG. 2E, the intersection of proximal bar 26 and butt 28 is depicted, with the convex heads of locking pins 45 protruding into recesses 72 in the outer side faces of butt 28.

Deployed State to Compact State—Release of Locking Tooth

When a user wants to change butt stock 10 from a deployed state to a collapsed state, the user first simultaneously pushes both locking pins 45 inwardly against the force applied by coil spring 62, e.g., with a thumb and opposing finger, see FIGS. 2D and 2E. When locking pins 45 are pushed inwardly at least to the extent that at least some of the convex part of the heads of locking pins 45 is located inside rotation locking holes 68 in proximal bar 26, the user applies a force to rotate proximal bar 26 relative to butt 28 around hinge 38. Such rotation moves the convex part of the heads of locking pins 45 out of rotation locking holes 70 in butt 28 so that locking pins 45 no longer prevent rotation of proximal bar 26 relative to butt 28 around hinge 38.

In FIG. 2F, the intersection of proximal bar 26 and butt 28 is depicted during collapse of butt stock 10 from deployed state where proximal bar 26 is rotated relative to butt 28 around hinge 38. In FIG. 2F, retention tube 64 is depicted cut-out, As is seen in FIG. 2F, no part of locking pins 45 is located inside rotation locking holes 70 in butt 26 and the convex heads of locking pins 45 are pressed against an inner surface of butt 28, compressing coil spring 62 so that ridges 66 of locking pins 45 do not contact proximal bar 26.

In FIG. 2G (compare to FIG. 2D), a cut out view of the intersection of proximal bar 26 and butt 28 is depicted, subsequent to the depicted in FIG. 2F after rotation of proximal bar 26 relative to butt 28 in the vertical plane around hinge 38 so that the quadrilateral assembly of butt stock 10 is partially collapsed. As a result, the convex heads of locking pins 45 can no longer pass through rotation locking holes 70 in butt 28 and the heads of locking pins 45 are pressed by coil spring 62 against an inner surface of butt 28. Importantly, butt 28 is dimensioned (especially in the depth dimension which in FIG. 2A is perpendicular to butt axis 36 and parallel to telescoping axis 34) that throughout the rotation of proximal bar 26 relative to butt 28 around hinge 38, the convex heads of locking pins 45 are pressed by coil spring 62 against an inner surface of butt 28.

In FIG. 2H, a side view of butt stock 10 is depicted wherein the quadrilateral assembly is in a partially collapsed state corresponding to FIG. 2G. Locking bar 32 and butt 28 are both rotated in the vertical plane relative to proximal bar 26 and cheek rest 30 so that in side view the parallelogram four-bar linkage defined by cheek rest 30, hinge 40, butt 28, hinge 38, proximal bar 26, hinge 44, locking bar 32 and hinge 42 has the shape of a rhomboid parallelogram as opposed to a right parallelogram (rectangle) as depicted in FIG. 2A in the fully deployed state of butt stock 10. Further, telescoping axis 34 and butt axis 36 are no longer perpendicular although both still are within the vertical plane of butt stock 10. As discussed above, locking pins 45 cannot protrude through locking holes 70 of butt 28. Importantly, as a result of the rotation around hinges 38, 40, 42 and 44, locking tooth 52 of locking bar 32 is withdrawn from and located outside of distal gap 54 in the top of proximal bar 26 and proximal gap 56 in the top of middle bar 24, so that the position of proximal bar 26 relative to middle bar 24 is no longer locked.

In FIG. 2I (compare to FIGS. 2B and 2C), a close up perspective view of the intersection of proximal bar 26, middle bar 24 and locking bar 32 of butt stock 10 is depicted where the quadrilateral assembly is in a partially collapsed state corresponding to FIGS. 2G and 2H, providing greater detail of how locking tooth 52 of locking bar 32 is outside of distal gap 54 in the top of proximal bar 26 and proximal gap 56 in the top of middle bar 24. Also seen is guide lip 50 extending from the bottom surface of proximal bar 26.

With reference to FIGS. 2G, 2H and 2I, once locking tooth 52 is outside of distal gap 54 in the top of proximal bar 26 and proximal gap 56 in the top of middle bar 24, a user can telescopically contracti middle bar 24 into proximal bar 26 in the usual way.

Deployed State to Compact State—Release of Telescoping Locking Pin

In FIG. 2J, a close up perspective view from the bottom of the intersection of distal bar 22 and middle bar 24 is depicted. The convex head of telescoping locking pin 47 is seen protruding through telescoping locking hole 74 from the bottom side of middle bar 24 near the distal end thereof.

In FIG. 2K, a side cross section equivalent to FIG. 2J is shown. Telescoping locking pin 47 is seen contained inside a hollow 76 in the bottom of distal bar 22, biased downwards by a coil spring 78, to protrude through telescoping locking hole 74 through the bottom of middle bar 24, thereby preventing any telescopic movement of distal bar 22 into middle bar 24.

As noted above with reference to FIGS. 2G, 2H and 2I, once locking tooth 52 is outside of distal gap 54 in the top of proximal bar 26 and proximal gap 56 in the top of middle bar 24, middle bar 24 can be telescopically contracted into proximal bar 26, that is to say, a user can push middle bar 24 in the direction of telescoping axis 34 into the hollow of proximal bar 26.

With reference to FIGS. 2L, 2M, 2N and 20, the telescopic contraction of middle bar 24 into proximal bar 26 eventually brings the convex head of telescoping locking pin 47 into contact with the inner surface of guide lip 50. As seen in FIGS. 2L, 2M, 2N and 20, as middle bar 24 and proximal bar 26 are telescopically contracted, contact of the convex head of telescoping locking pin 47 with the inner surface of guide lip 50 forces telescoping locking pin 47 upwards into hollow 76 in distal bar 22 while compressing coil spring 78. When telescoping locking pin 47 is pushed far enough into hollow 76, FIG. 2N, telescoping locking pin 47 no longer prevents distal bar 22 from sliding into the hollow of middle bar 24. Further force applied by a user telescopically contracts distal bar 22 into middle bar 24 while spring 78 remains compressed and the convex head of telescoping locking pin 47 is pressed and slides along against an inner surface of middle bar 24.

Deployed State to Compact State—Collapsing the Quadrilateral Assembly

With reference to FIGS. 2P and 2Q, the user continues pushing distal bar 22 in a proximal direction towards butt 28, e.g., with the palm of the left hand.

As a result, the force applied by the user slides distal bar 22 into middle bar 24 until complete telescopic contraction which length is dictated by the length and details of construction of distal bar 22 and of middle bar 24 where a majority of distal bar 22 is located inside the hollow of middle bar 24, see FIG. 2Q.

Further, the force applied by the user slides middle bar 24 into proximal bar 26 until complete telescopic contraction which length is dictated by the length and details of construction of middle bar 24 and of proximal bar 26 where a majority of middle bar 24 is located inside the hollow of proximal bar 26, see FIG. 2Q.

Independently of the telescopic contraction of the telescopic assembly of butt stock 10, which comprises distal bar 22, middle bar 24 and proximal bar 26, caused by the user pushing distal bar 22 in a proximal direction, the user also forces cheek rest 30 and butt 28 together, e.g., by closing the right hand around these two components, thereby collapsing the quadrilateral assembly comprising proximal bar 28, hinge 38, butt 28, hinge 40, cheek rest 30, hinge 42, locking bar 32 and hinge 44. By "collapsing" is meant that two of the four opposing angles of the quadrilateral are made progressively more acute, e.g., in butt stock 10 the angle defined by butt 28, hinge 40 and cheek rest 30 and the angle defined by proximal bar 26, hinge 44 and locking bar 32. Further, the progressive collapsing changes the angle between telescoping axis 34 and butt axis 36 to be progressively further from perpendicular.

The Compact State

Butt stock 10 is depicted in the compact state in FIG. 2Q (side view), FIG. 2R (viewing from the distal end in a proximal direction), FIG. 2S (viewing from the proximal end in a distal direction), FIG. 2T (view from the bottom at cheek rest 30) and FIG. 2U (view from the top at butt 28). In FIG. 2U, retention tube 64 is depicted as transparent allowing rotation locking pins 45 and coil spring 62 to be seen.

From FIGS. 2Q-2U a number of features of butt stock 10 in the compact state are seen.

Adaptor

In the compact state of butt stock 10, adaptor locking head 46 is clear of obstruction and accessible, allowing attachment and detachment of butt stock 10 to a handgun even when butt stock 10 is in a compact state.

Telescoping Axis

In the compact state, telescoping axis 34 and butt axis 36 are within 5° of parallel (in butt stock 10, ±1° of parallel). In some alternative embodiments, in the compact state the telescoping axis and the butt axis are within 30°, within 20°, within 10° and even within 5° of parallel. Generally, the closer to parallel the two axes are, the more compact the butt stock is in the compact state and therefore typically is more preferred.

Configuration and Dimensions of Telescopic Assembly

In the compact state of butt stock 10 described above, distal bar 22 and middle bar 24 are both dimensioned and configured so that more than 90% of the length of distal bar 22 is contained inside middle bar 24 when fully retracted thereinto. In some alternative embodiments, in the compact state the distal bar and middle bar are dimensioned and configured that more than 50%, more than 60%, more than 70%, more than 80% and even more than 90% of the length of the distal bar is contained inside the middle bar when fully retracted thereinto.

In the compact state of butt stock 10 described above, middle bar 24 and proximal bar 26 are both dimensioned and configured so that more than 90% of the length of middle bar 24 is contained inside proximal bar 26 when fully retracted thereinto. In some alternative embodiments, in the compact state the middle bar and proximal bar are dimensioned and configured that more than 50%, more than 60%, more than 70%, more than 80% and even more than 90% of the length of the middle bar is contained inside the proximal bar when fully retracted thereinto.

Configuration and Dimensions of Butt

In butt stock 10, butt 28 is dimensioned and configured to constitute an open ended trough that in the compact state contains the telescoping components of butt stock 10. Such dimensioning and configuration includes that the width between the inner faces of the walls of butt 28 are greater than the width of proximal bar 26, that the depth of the trough of butt 28 is deeper than the height of proximal bar 26, that hinge 38 is located at the top edges of both butt 28 and proximal bar 26. Importantly, the length of butt 28 (parallel to butt axis 36) from hinge 38 is sufficient to contain most of the telescoping assembly with only a small portion of adaptor 14 not enclosed allowing access to adaptor release button 48 when butt stock 10 is in a compact state, see FIG. 2Q. In some embodiments, the butt is even longer, for example, even to extending far enough to enclose all of the adaptor. In some embodiments, the distal end of the butt (the part that in the compact state of the butt stock is closest to the adaptor extends upwards in a direction perpendicular to the butt axis to cover at least some of the sides of the adaptor. In some embodiments, the distal end of the butt includes a wall that covers some or all of the adaptor from the axial direction.

In butt stock 10, in the compact state the distal portion of the telescopic assembly can be seen, see FIG. 2Q. In some alternate embodiments, the walls of the butt are higher, for instance along the entire length of the butt, shielding more of the telescoping assembly from view than in butt stock 10 when in the compact state and even entirely shielding the telescoping assembly from view when in the compact state.

Configuration and Dimensions of Cheek Rest

In butt stock 10, cheek rest 30 is trough-shaped and locking bar 32 is sufficiently narrow along most of the length to fit inside the trough of cheek rest in the compact state, the exception being near locking tooth 52 where locking bar 32 has a width that is substantially the same as that of cheek rest 30. As a result, in the compact state, the portion of locking bar 32 near locking tooth 52 is visible, see FIG. 2T. In some alternative embodiments, the locking bar is sufficiently narrow along the entire length to fit in the trough of the cheek rest. In some such embodiments, the cheek rest is longer than as depicted in butt stock 10, for example, in some embodiments covering all of the locking bar, and in some embodiments even further, for example close to or even contacting the adaptor.

Configuration of Cheek Rest

In butt stock 10, cheek rest 30 is narrower than the width between the inner faces of the walls of butt 28. As a result, in the compact state butt stock 10 has a stepped cross section, see FIG. 2T where the rims of the walls of butt 28 are visible next to cheek rest 30. As a result, in the compact state the rims of the walls of cheek rest 30 are located inside the trough of butt 28. The step in the cross section caused by the difference in width is not significant, so that in cross section in the compact state butt stock 10 is approximately a round-edged rectangle that can be comfortably held, see FIG. 1C.

In some alternate embodiments, the width of the cheek rest is substantially equal or identical to the width of the butt, one exception being the flanges that are part of the hinges. As a result, in some such embodiments the butt and the cheek rest together constitute a partial clam shell package of the butt stock so in the compact state the edges of the butt and the cheek rest are in contact.

In some alternate embodiments, the cheek rest is wider than the butt and, in the compact state, portions of the butt are contained within the trough of the cheek rest.

Extension/Retraction of the Telescopic Assembly

As discussed above, a characteristic of some embodiments of a butt stock such as butt stock 10 is that locking the quadrilateral assembly in the open position requires that middle bar 24 be fully extended out of proximal bar 26, allowing locking tooth 52 of locking bar 32 to enter proximal gap 56 in middle bar 24. If middle bar 24 is not fully extended, locking tooth 52 cannot enter proximal gap 56 so that hinges 38, 40, 42 and 44 cannot rotate to a fully open position. Once middle bar 24 is fully extended and locking tooth 52 enters proximal gap 56, subsequent retraction of middle bar 24 into proximal bar 26 is not possible, allowing the telescoping assembly to remain in the extended conformation even when an attached handgun is fired and the consequent recoil applies a substantial force in the proximal direction through the telescoping assembly along telescoping axis 34.

However, some embodiments, of a butt stock according to the teachings herein, such as butt stock 10, are configured to allow extension and retraction of some or all of the telescopic assembly when the butt stock is in the compact state and the parallelogram assembly is in the closed position. For example, from the compact state of butt stock 10 as depicted in FIGS. 1C and 2Q, a user grips the closed-position quadrilateral assembly in one hand and with the other hand holds adaptor 14 and pulls distally along telescoping axis 34. Distal bar 22 is pulled out of middle bar 24 until telescoping locking pin 47 of distal bar 22 passes through telescoping locking hole 74 of middle bar 24, thereby locking distal bar 22 in an extended conformation relative to middle bar 24. Concurrently, middle bar 24 is pulled out of proximal bar 26 until fully extended relative to proximal bar 26. Although distal gap 54 of proximal bar 26 and proximal gap 56 of middle bar 24 are aligned, as long as the quadrilateral assembly is in the closed position, extension/retraction of middle bar 24 relative to proximal bar 26 is not locked.

In such a state, where the telescopic assembly is in an extended conformation while the quadrilateral assembly is in a closed position, butt stock 10 is useable as a hammer, e.g., to break glass windows or as a tool that extends the reach of the user, see FIG. 1D.

Use of a Butt Stock Such as Butt Stock 10

A person having ordinary skill in the art of shooting will understand the operation and use of a butt stock according to the teachings herein by perusal of the above description and the accompanying figures. For the sake of completeness, a specific embodiment of the use of butt stock 10 is described in detail.

A right-handed user is carrying a holstered handgun and a butt stock 10 in a compact state in a magazine pouch or clipped to a belt underneath a jacket. Due to the small size of butt stock 10 in the compact state, it is not possible to see the presence of the butt stock.

The user perceives a situation that potentially requires accurate fire from the handgun. While moving to a firing position, the user draws the handgun with the right hand and butt stock 10 with the left hand. In a motion similar to loading a magazine into the handgun, the user inserts adaptor locking head 46 into the appropriate gap in the handgun, thereby attaching butt stock 10 to the handgun. While holding the handgun by the grip with the right hand, the user grasps butt 28 (preferably the distal portion that in the compact state is closest to adaptor 14) between the thumb and forefinger of the left hand, then pulls the left hand back, thereby changing butt stock 10 from the initial compact state to the deployed state depicted in FIG. 1A. The user feels that rotation locking pins 45 pass into rotation locking holes 68 and 70, ridges 66 being pushed against the inside of proximal bar 26 so that the parallelogram assembly is locked in the open position, and that telescoping locking pin 47 passes through telescoping locking hole 74 so that the telescopic assembly is locked in the extended conformation.

The user then lifts the handgun with the right hand and adopts a firing position having 4 points of contact: the right cheek resting on cheek rest 30, the proximal end of butt 28 pressed into the right shoulder, the right hand holding the handgun grip, while the right index figure rests on the right side of the trigger guard ready to be moved into the trigger guard to pull the trigger if necessary with the left hand encircling the right hand in a manner similar to a Weaver stance.

Adaptor

In the embodiment depicted above, butt stock 10 includes an adaptor to couple with a handgun. Depicted is adaptor 14 for coupling with a Glock 19 pistol. Different embodiments of the butt stock include suitable different adaptors to couple with different handguns. In some embodiments, an adaptor is a permanent component of the butt stock, in some such embodiments being integrally formed with the distal bar or equivalent component. In some alternate embodiments, the adaptor is replaceable, i.e., is configured to allow simple replacement of one adaptor with another adaptor using a simple tool or tools (e.g., a screw driver or allen wrench) and in some embodiments no tool (e.g., is held in place with a manually-removable pin) allowing a specific butt stock to be used with different types of handguns by replacing the adaptor.

Adaptor 14 depicted in the Figures is a dedicated adaptor that fits into an integral part of a Glock 19, the gap in the grip. The advantage of such an adaptor is that the butt stock can be attached to a handgun or detached from a handgun quickly and easily, even in tactical situations.

Some handguns do not have a feature that allows such easy attachment/detachment of a butt stock or a user is not interested in such easy attachment/detachment. In some such embodiments, an adaptor of a butt stock is a different type of component. For example, in some embodiments an adaptor comprises a ring configured to surround an integral feature of a handgun such as the grip. In some such embodiments, the adaptor comprises a ring that can be closed around the grip of a handgun, for example, similar in construction and/or operation to a circular clamp or pipe clamp including one or more ring parts that can be closed around the grip or other integral part of a handgun. In some such embodiments, the adaptor comprises a constricting ring similar in construction and/or operation to a tightenable hose clamp including one or more ring parts that can be constricted around the grip or other integral part of a handgun.

Alternatively, in some embodiments there is provided a mating component matched to mate with the adaptor, the mating component being separately attachable to a handgun prior to attachment of a butt stock. Such a mating component is dimensioned and configured to mate with a suitable adaptor, allowing simple attachment/detachment of a butt stock provided with the suitable adaptor, preferably even in tactical situations.

In butt stock 10, in the compact state adaptor release button 48 is not associated with any other component of butt stock 10 except for adaptor 14 and the only function of adaptor release button 48 is to release adaptor 14 from attachment to a handgun. In some alternative embodiments, in the compact state of a butt stock, the adaptor release button engages a part of some other component of the butt stock such as the butt and, through a biasing mechanism such as a spring, actively holds the butt stock locked in the compact state. In such embodiments, when the adaptor locking head is attached to a handgun, such attachment releases the engagement of the adaptor release button with the part of the component so that the butt stock can be changed to the deployed state.

Attachment Component

In some embodiments, a collapsible butt stock according to the teachings herein further comprises an attachment component. In such embodiments, the attachment component allows a user to secure the butt stock when in a compact state to themselves or to another object to help prevent loss of the collapsible butt stock, especially in a tactical situation.

In some embodiments an attachment component comprises or is a magnet, e.g., a rare earth magnet, to allow a user to secure the butt stock to a suitable ferromagnetic object, for example, a magazine inside a pouch worn by the user or a dedicated metal plate worn by the user. The modest dimensions and weight of the butt stock allow a magnet to be sufficient to secure the butt stock to a user and to prevent a secured butt stock from interfering with the normal activity of a user.

Alternatively or additionally, in some embodiments an attachment component comprises a flat retention clip, e.g., of stainless steel clip, allowing the butt stock to be secured to a user by hanging the butt stock on a belt or webbing where the belt or webbing is located between the retention clip and the butt stock.

Alternatively or additionally, in some embodiments an attachment component comprises or is a part of a hook-and-loop fastener, e.g., Velcro®, to allow a user to secure the butt stock to a suitably located opposite part of a hook-and-loop fastener. Typical suitable opposite-part of the hook-and-loop fastener can include such a part of a fasterner that is part of a belt, webbing or vest worn by the user.

Alternatively or additionally, in some embodiments an attachment component comprises a lanyard, one end of the lanyard secured to the butt stock and the other end securable to a user or an object worn by the user such as a belt, webbing or vest. In some preferred such embodiments the lanyard is extensible, e.g., comprises a coiled section which length can be varied (analogous to telephone cords from the 1970s) or a wound section on a spring-loaded wheel (similar to a retractable key chain).

Retention Tube

Butt stock 10 depicted above includes a retention tube 64 to physically contain rotation locking pins 45 and coil spring 62. Some embodiments of a butt stock according to the teachings herein have an otherwise similar or identical rotation-locking mechanism which is devoid of a retention tube such as 64.

Material

A collapsible butt stock according to the teachings herein is made of any suitable material or combination of materials, for example, metals such as aluminum, aluminum alloys, magnesium, magnesium alloys, steel, carbon fiber and polymers. In a prototype made by the inventor, except for the middle bar 24, all of the structural components of the butt stock (distal bar 22, proximal bar 26, butt 28, cheek rest 30 and locking bar 32) were made of fiber-reinforced polymer (e.g., a fiber reinforced polymer such as Nylon or Nylon derivative) known in the art of gun smithing. Middle bar 24 which was made of 1 mm thick aluminum because it was found that using current technology, it was challenging to make a middle bar 24 of fiber-reinforced polymer that was sufficiently compact yet could survive the recoil of repeated firing of an attached handgun.

Dimensions

It is preferred that a butt stock according to the teachings herein be as compact as possible for one or more reasons. In some embodiments, it is desired that the butt stock be concealable and/or easy to carry in the compact state. On the other hand, the dimensions of the butt stock must be large enough to make the butt stock useful in stabilizing firing of a handgun and robust enough to survive rough handling and repeated recoil.

In some embodiments, in the compact state a butt stock according to the teachings herein has a length of 10-20 cm long (dimension parallel to the butt axis), and a width and depth of 2-8 cm, more preferably 2-6 cm (dimensions perpendicular to the length).

In a prototype made by the inventor, in the compact state a butt stock 10 had a length of 16 cm, a width of 28 mm (being the width of butt 28 while the width of cheek rest 30 was 20 mm) and a depth of 47 mm. The length of the prototype in the deployed state (the dimension parallel to the telescoping axis 34 including to the tip of the adaptor) was 33 cm.

Number of Telescoping Parts

In the embodiment depicted in the Figures, butt stock 10 includes a telescopic assembly with three telescoping parts: proximal bar 26, middle bar 24 and distal bar 22 to connect butt 28 to adaptor 14. It was found that using current material technology, a three-part telescopic assembly connecting adaptor 14 to butt 28 was preferred to ensure that in a deployed state when attached to a handgun, the handgun/butt distance was sufficient for comfortable and accurate firing while ensuring that the components were sufficiently strong to undergo the recoil of repeated firing of the handgun without damage.

In some related embodiments, a butt stock according to the teachings herein includes a telescopic assembly with only two telescopic parts, a proximal bar and a distal bar. Typically but not necessarily, such embodiments have a larger length dimension in the compact state. In such embodiments, preferably but not necessarily, the proximal bar is substantially similar or identical in function and construction as described hereinabove for proximal bar 26 of butt stock 10 and the distal bar is substantially similar or identical in function and construction as described hereinabove for middle bar 24 of butt stock 10, except that an adaptor is attached to the distal end of the distal bar.

In some related embodiments, a butt stock according to the teachings herein includes a telescopic assembly with more than three telescoping parts, e.g., four, five, six or even more telescoping parts. Some such embodiments are expensive due to the components being made of comparatively expensive materials to ensure that the butt stock is sufficiently strong to undergo the recoil of repeated firing of the handgun without damage.

In such embodiments, preferably but not necessarily, the proximal bar is substantially similar or identical in function and construction as described hereinabove for proximal bar 26 of butt stock 10, the most proximal middle bar that is associated with the proximal bar is substantially similar or identical in function and construction as described hereinabove for middle bar 24 of butt stock 10, there is a distal bar substantially similar or identical in function and construction as described hereinabove for distal bar 22 of butt stock 10, and there are one or more additional middle bars between the distal bar and the most proximal middle bar.

Unless otherwise defined, all technical and scientific terms used herein have the same meaning as commonly understood by one of ordinary skill in the art to which the invention pertains. In case of conflict, the specification, including definitions, will take precedence.

As used herein, the terms "comprising", "including", "having" and grammatical variants thereof are to be taken as specifying the stated features, integers, steps or components but do not preclude the addition of one or more additional features, integers, steps, components or groups thereof. These terms encompass the terms "consisting of" and "consisting essentially of".

As used herein, the indefinite articles "a" and "an" mean "at least one" or "one or more" unless the context clearly dictates otherwise.

As used herein, when a numerical value is preceded by the term "about", the term "about" is intended to indicate +/−10%.

As used herein, a phrase in the form "A and/or B" means a selection from the group consisting of (A), (B) or (A and B). As used herein, a phrase in the form "at least one of A, B and C" means a selection from the group consisting of (A), (B), (C), (A and B), (A and C), (B and C) or (A and B and C).

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Citation or identification of any reference in this application shall not be construed as an admission that such reference is available as prior art to the invention.

Section headings are used herein to ease understanding of the specification and should not be construed as necessarily limiting.

The invention claimed is:

1. A butt stock reversibly attachable to a handgun, comprising:

a. a telescopic assembly, comprising:

a telescoping axis comprising at least two telescopic components:

a proximal bar constituting a proximal portion of said telescopic assembly, and a distal bar physically associated with said proximal bar to telescope relative to said proximal bar in the direction of said telescoping axis, and, an adaptor attached to said distal bar, said adaptor configured for reversibly attaching the butt stock to a handgun;

b. a quadrilateral assembly comprising:

a proximal bar, a butt, a first hinge movably connecting said butt to said proximal bar, a cheek rest, a second hinge movably connecting said cheek rest to said butt, a locking bar, a third hinge movably connecting said locking bar to said cheek rest, a fourth hinge movably connecting said locking bar to said proximal bar, a butt axis passing through the rotation axis of said first hinge and said second hinge;

said quadrilateral assembly constituting a planar quadrilateral four-bar linkage;

the butt stock having at least two states:

i. a deployed state wherein said telescopic assembly is in an extended conformation and said quadrilateral assembly is in an open position, ii. a compact state wherein said telescopic assembly is in a contracted conformation and said quadrilateral assembly is in a closed position, wherein when the butt stock is in said deployed state and attached to a handgun, said cheek rest is configured to serve as a contact point for a cheek of the user of the handgun and said butt is configured to serve as a contact point for a shoulder of the user of the handgun.

2. The butt stock of claim 1, said quadrilateral assembly constituting a planar parallelogram four-bar linkage, wherein:

in said deployed state said telescopic assembly is in an extended conformation and said quadrilateral assembly is in an open position wherein the four inner angles of the quadrilateral are between 45° and 135°, and in said compact state said telescopic assembly is in a contracted conformation and said quadrilateral assembly is in a closed position wherein two inner angles of the quadrilateral are less than 30°.

3. The butt stock of claim 1, wherein said adaptor is attached to a distal end of said distal bar.

4. The butt stock of claim 1, wherein in said open position the four inner angles of the quadrilateral are between 60° and 120°.

5. The butt stock of claim 1, wherein the two inner angles of the quadrilateral that are less than 30° in the closed position of the quadrilateral assembly are the angles defined by butt, second hinge, cheek rest and by locking bar, fourth hinge, proximal bar.

6. The butt stock of claim 2, wherein in said closed position two inner angles of the quadrilateral are less than 20°.

7. The butt stock of claim 1, said bars of said telescopic assembly being coaxial.

8. The butt stock of claim 1, wherein in said contracted conformation of said telescopic assembly, a majority of said distal bar is inside said proximal bar.

9. The butt stock of claim 1, said telescopic assembly comprising only two telescoping components, said proximal bar and said distal bar.

10. The butt stock of claim 1, said telescopic assembly comprising only three telescoping components, said proximal bar, said distal bar and a middle bar located between said proximal bar and said distal bar.

11. The butt stock of claim 10, wherein in said contracted conformation of said telescopic assembly: a majority of said distal bar is inside said middle bar and said proximal bar; and a majority of said middle bar is inside said proximal bar.

12. The butt stock of claim 1, said telescopic assembly comprising at least four telescoping components, said proximal bar, said distal bar and at least two middle bars telescopically located between said proximal bar and said distal bar.

13. The butt stock of claim 10, further comprising a distal telescope locking mechanism that prevents said distal bar from telescoping to a contracted conformation relative to a preceding said middle bar unless said distal telescope locking mechanism is released.

14. The butt stock of claim 13, wherein said distal telescope locking mechanism comprises a component that, when a said middle bar is telescoped to a contracted conformation relative to said proximal bar, said distal telescope locking mechanism is released, allowing said distal bar to telescope to a contracted conformation relative to a more proximal said middle bar.

15. The butt stock of claim 1, further comprising a rotation-locking mechanism that prevents said quadrilateral assembly in said open position from closing to said closed position unless said rotation-locking mechanism is released.

16. The butt stock of claim 15, wherein said rotation-locking mechanism comprises a locking component that is ordinarily biased to a locked position preventing rotation of said proximal bar relative to said butt, said locking component configured to be moved by a user to an unlocked position where rotation of said proximal bar relative to said butt is not prevented.

17. The butt stock of claim 1, further comprising a proximal telescoping locking mechanism that prevents said telescopic assembly in said extended conformation from retracting to said retracted conformation unless said proximal telescoping mechanism is released.

18. The butt stock of claim 15, further comprising a proximal telescoping locking mechanism that prevents said telescopic assembly in said extended conformation from retracting to said retracted conformation unless released, said proximal telescoping locking mechanism configured so that:

when said quadrilateral assembly is locked in said open configuration, said proximal telescoping locking mechanism prevents said telescopic assembly in said extended conformation from retracting to said retracted conformation; and when said quadrilateral assembly is at least partially moved from said open configuration, said proximal telescoping locking mechanism does not prevent said telescopic assembly in said extended conformation from retracting to said retracted conformation.

19. The butt stock of claim 18, wherein said proximal telescoping locking mechanism comprises a locking tooth physically associated with said locking bar and a proximal gap in a bar most proximal to said proximal bar, so that:

when said quadrilateral assembly is locked in said open configuration, said locking tooth is located inside said proximal gap, preventing axial movement of said bar most proximal relative to said proximal bar; and when said quadrilateral assembly is not locked in said open configuration, said locking tooth is not located inside said proximal gap.

20. The butt stock of claim 1, configured so that in said compact state, said adaptor is attachable to and detachable from a handgun.

* * * * *